US008020226B2

(12) United States Patent
Landry

(10) Patent No.: US 8,020,226 B2
(45) Date of Patent: Sep. 20, 2011

(54) CRIB SAFETY SHEET/BLANKET

(75) Inventor: Jo-Ann Landry, Advance, NC (US)

(73) Assignee: Safety Roo, Inc., Clemmons, NC (US)

( * ) Notice: Subject to any disclaimer, the term of this patent is extended or adjusted under 35 U.S.C. 154(b) by 0 days.

(21) Appl. No.: 12/749,443

(22) Filed: Mar. 29, 2010

(65) Prior Publication Data

US 2010/0242173 A1 Sep. 30, 2010

Related U.S. Application Data

(60) Continuation of application No. 12/119,319, filed on May 12, 2008, now abandoned, which is a continuation of application No. 10/840,401, filed on May 7, 2004, now Pat. No. 7,370,377, which is a continuation-in-part of application No. 10/630,752, filed on Jul. 31, 2003, now Pat. No. 6,857,146, which is a division of application No. 10/176,083, filed on Jun. 21, 2002, now Pat. No. 6,681,422, which is a continuation-in-part of application No. 10/115,896, filed on Apr. 5, 2002, now Pat. No. 6,631,528, said application No. 10/840,401 is a continuation-in-part of application No. 10/630,931, filed on Jul. 31, 2003, now Pat. No. 6,848,131, which is a division of application No. 10/176,083.

(60) Provisional application No. 60/356,773, filed on Feb. 15, 2002.

(51) Int. Cl.
*A47G 9/04* (2006.01)

(52) U.S. Cl. ..... 5/494; 5/496; 5/498; 5/500; 5/923; 2/69.5; 128/872; 128/873

(58) Field of Classification Search ..... 5/494–500, 5/482, 485, 502, 922, 923; 2/69.5, 69; 128/872, 128/873; 24/72.5
See application file for complete search history.

(56) References Cited

U.S. PATENT DOCUMENTS

| | | | |
|---|---|---|---|
| 429,894 | A | 6/1890 | Doremus |
| 648,621 | A | 5/1900 | Hooper et al. |
| 857,507 | A | 6/1907 | Wilson |
| 1,474,738 | A | 11/1923 | Thierjung |
| 1,897,521 | A | 2/1933 | LaGarde |

(Continued)

FOREIGN PATENT DOCUMENTS

| | | |
|---|---|---|
| CH | 658177 | 10/1986 |

(Continued)

OTHER PUBLICATIONS

Gershman, Maurice, M.D. Self-Adhering Nylon Tapes. Journal of A.M.A. Oct. 1958, vol. 168, No. 7, the entire disclosure.

(Continued)

*Primary Examiner* — Robert G. Santos
(74) *Attorney, Agent, or Firm* — McDermott Will & Emery LLP

(57) ABSTRACT

A crib safety sheet and separable blanket with a sheet portion for selectively removing at least the blanket from the sheet, when the sheet is attached to a sleep surface. The separable blanket defining at least two edges for wrapping the blanket about an infant. The blanket may be removed from the sheet by separating the blanket, or by separating a sheet material portion attached to the blanket, from the sheet covering the sleep surface.

2 Claims, 22 Drawing Sheets

U.S. PATENT DOCUMENTS

| | | | |
|---|---|---|---|
| 1,964,271 | A | 6/1934 | O'Dwyer |
| 2,342,069 | A | 2/1944 | Wilkinson |
| 2,423,392 | A | 7/1947 | Krogh |
| 2,440,891 | A | 5/1948 | Bockhold |
| 2,450,923 | A | 10/1948 | Spiro, Jr. |
| 2,481,741 | A | 9/1949 | Graves |
| 2,503,427 | A | 4/1950 | Waterworth |
| 2,563,501 | A | 8/1951 | Sperling |
| 2,596,547 | A | 5/1952 | Guest |
| 2,677,843 | A | 5/1954 | Moynihan |
| 2,702,385 | A | 2/1955 | Goldberg |
| 2,940,443 | A | 6/1960 | Baker |
| 3,521,309 | A | 7/1970 | Evans |
| 3,739,399 | A | 6/1973 | Sheahon |
| 3,845,513 | A | 11/1974 | Hubner et al. |
| 3,854,156 | A | 12/1974 | Williams |
| 3,987,505 | A | 10/1976 | Hickey |
| 4,172,300 | A | 10/1979 | Miller |
| 4,199,830 | A | 4/1980 | Ogata et al. |
| 4,202,052 | A | 5/1980 | Bilanzich |
| 4,445,242 | A | 5/1984 | Bowen |
| 4,597,121 | A | 7/1986 | Bouma |
| 4,627,363 | A | 12/1986 | Jones |
| 4,653,131 | A | 3/1987 | Diehl |
| 4,783,866 | A | 11/1988 | Simmons et al. |
| 4,839,934 | A | 6/1989 | Rojas |
| 4,858,259 | A | 8/1989 | Simmons et al. |
| 4,858,625 | A | 8/1989 | Cramer |
| 4,878,258 | A | 11/1989 | Casey |
| 4,887,326 | A | 12/1989 | O'Brien et al. |
| 4,897,885 | A | 2/1990 | Lunt |
| 4,937,904 | A | 7/1990 | Ross |
| 5,046,204 | A | 9/1991 | Mohler |
| 5,084,929 | A | 2/1992 | Staudinger |
| 5,148,560 | A | 9/1992 | Torres |
| 5,168,590 | A | 12/1992 | O'Sullivan |
| 5,243,724 | A | 9/1993 | Barnes |
| 5,297,304 | A | 3/1994 | O'Sullivan |
| 5,367,731 | A | 11/1994 | O'Sullivan |
| D355,068 | S | 2/1995 | Prendergast |
| 5,400,803 | A | 3/1995 | Vines |
| 5,488,746 | A | 2/1996 | Hudson |
| 5,557,817 | A | 9/1996 | Haddock |
| 5,572,757 | A | 11/1996 | O'Sullivan |
| 5,722,094 | A | 3/1998 | Ruefer |
| 5,746,219 | A | 5/1998 | McConnell |
| 5,852,827 | A | 12/1998 | Lear |
| 5,996,147 | A | 12/1999 | Trimble |
| 6,009,576 | A | 1/2000 | Gramme et al. |
| 6,105,168 | A | 8/2000 | Hazen |
| 6,243,896 | B1 | 6/2001 | Osuna et al. |
| 6,286,163 | B1 | 9/2001 | Trimble |
| 6,301,729 | B1 | 10/2001 | Hall et al. |
| 6,631,528 | B2 | 10/2003 | Landry |
| 6,681,422 | B2 | 1/2004 | Landry |
| 6,817,048 | B1 | 11/2004 | LaRosa |
| 6,848,131 | B1 | 2/2005 | Landry |
| 6,857,146 | B2 | 2/2005 | Landry |
| 7,111,344 | B2 | 9/2006 | French et al. |
| 7,370,377 | B2 | 5/2008 | Landry |
| 7,673,354 | B2 * | 3/2010 | Fader ..... 5/494 |
| 2003/0154548 | A1 | 8/2003 | Landry |
| 2003/0154549 | A1 | 8/2003 | Landry |
| 2004/0019970 | A1 | 2/2004 | Landry |
| 2004/0199999 | A1 | 10/2004 | Landry |
| 2005/0028278 | A1 | 2/2005 | Landry |
| 2007/0061968 | A1 | 3/2007 | Fader |
| 2009/0113630 | A1 | 5/2009 | Landry |
| 2010/0242173 | A1 * | 9/2010 | Landry ..... 5/494 |
| 2010/0275373 | A1 * | 11/2010 | Kaplan et al. ..... 5/494 |
| 2010/0275932 | A1 * | 11/2010 | Shackleton ..... 128/872 |

FOREIGN PATENT DOCUMENTS

| | | | |
|---|---|---|---|
| DE | 682773 | C | 10/1939 |
| FR | 2730617 | A | 8/1996 |
| GB | 927094 | | 5/1963 |
| GB | 2281510 | A | 3/1995 |
| WO | 9317606 | | 9/1993 |

OTHER PUBLICATIONS

International Search Report for PCT/US03/04509.

International Search Report for PCT/US05/16349, dated Feb. 24, 2006.

Supplementary European Search Report for European Application No. 03742754.9, dated May 24, 2006.

International Search Report for PCT/US03/04509, dated May 6, 2005.

* cited by examiner

CRIB SAFETY SHEET/BLANKET

CROSS-REFERENCE TO RELATED APPLICATION

This application is a continuation application of U.S. patent application Ser. No. 12/119,319, filed May 12, 2008, which is a continuation application of U.S. patent application Ser. No. 10/840,401, filed on May 7, 2004, now U.S. Pat. No. 7,370,377, which is a Continuation-In-Part of U.S. Utility application Ser. Nos. 10/630,752 and 10/630,931, both filed on Jul. 31, 2003, which are Divisional Applications of U.S. Utility application Ser. No. 10/176,083 filed on Jun. 21, 2002, now U.S. Pat. No. 6,681,422, which is a Continuation-In-Part of U.S. Utility application Ser. No. 10/115,896 filed on Apr. 5, 2002, now U.S. Pat. No. 6,631,528, which claims priority from U.S. Provisional Patent Application Ser. No. 60/356,773, filed Feb. 15, 2002, and the disclosures of each are herein incorporated by reference.

BACKGROUND OF THE INVENTION

1. Field of the Invention

The present invention relates to sheets and blankets for an infant's crib or bed, and more particularly to a sheet and removable blanket combination for securing an infant on a sleep surface.

2. Description of Related Art

There are a variety of infant blankets and coverings for infants present in the art. In the past many designs functioned only to keep an infant warm while sleeping. Today much more is known about infant sleeping patterns and sleeping safety. The concern for infant warmth is now shared with the concern for infant comfort and safety. Some infants frequently change positions while sleeping, so it is desirable to make an infant's sleeping environment as free as possible of suffocation hazards while at the same time insuring the infant is kept in a secure sleeping position.

An additional consideration in infant bedding design is Sudden Infant Death Syndrome (SIDS) in which an apparently healthy infant will expire in a crib for no apparent reason. While the causes of SIDS still remain somewhat a mystery it is thought that sleeping in the prone position may increase the likelihood of SIDS. A device to maintain an infant in the supine position while sleeping is therefore desirable.

U.S. Pat. No. 2,677,834 discloses a crib blanket which is secured to the side of a crib with snap together fasteners. The blanket also contains a single strap along the blanket's upper margin for securing an infant to the blanket. This invention will keep a blanket secure in its relation to the crib but, unlike the present invention, uses only a single strap to secure the infant under the blanket. Further, the blanket is not attached to the crib sheet.

Other designs such as U.S. Pat. Nos. 3,845,513 and 4,202,052, each disclose fitted garments which are sewn to crib sheets to restrict the movements of infants. The '513 patent shows a sleeping bag blanket secured to a bed linen sheet, the baby being secured in the sleeping bag by a diaper retainer with button down flaps and by a pull down zipper. The '052 patent shows a sheet with a central pleat having an opening defined therein to which a jacket may be attached, the jacket being secured around the infant by what appear to be button or snap fasteners. No blanket is shown. Infants must be manipulated to be secured in these garment-type inventions, which often wakes the infant as he or she is being put to bed, a highly undesirable side effect.

U.S. Pat. No. 6,301,729 discloses one bedding device designed to prevent SIDS. It is a pocket like blanket device which secures an infant between one edge of the pocket and a mattress. This bedding device does not secure an infant in the same manner as the present invention however, nor does it permit an infant to be positioned on its side without the risk of the infant moving into the prone position while sleeping. The '301 invention also does not prevent an infant from squirming downward into the blanket pocket which could cause a suffocation hazard.

Several other prior related devices are shown in the related references of U.S. Pat. No. Des. 355,068; U.S. Pat. No. 429,894; U.S. Pat. No. 857,507; U.S. Pat. No. 6,301,729; U.S. Pat. No. 3,845,513; U.S. Pat. No. 3,987,505; U.S. Pat. No. 4,199,830; U.S. Pat. No. 1,964,271; U.S. Pat. No. 2,423,392; U.S. Pat. No. 2,481,741; U.S. Pat. No. 2,503,427; U.S. Pat. No. 2,563,501; U.S. Pat. No. 2,596,547; U.S. Pat. No. 2,702,385; U.S. Pat. No. 3,739,399; U.S. Pat. No. 3,854,156; U.S. Pat. No. 3,987,505; U.S. Pat. No. 4,172,300; U.S. Pat. No. 4,445,242; U.S. Pat. No. 4,597,121; U.S. Pat. No. 4,627,363; U.S. Pat. No. 4,783,866; U.S. Pat. No. 4,839,934; U.S. Pat. No. 4,858,259; U.S. Pat. No. 4,878,258; U.S. Pat. No. 4,887,326; U.S. Pat. No. 4,897,885; U.S. Pat. No. 4,937,904; U.S. Pat. No. 5,046,204; U.S. Pat. No. 3,521,309; U.S. Pat. No. 2,342,069; U.S. Pat. No. 5,084,929; U.S. Pat. No. 5,168,590; U.S. Pat. No. 5,243,724; U.S. Pat. No. 5,297,304; U.S. Pat. No. 5,367,731; U.S. Pat. No. 5,400,803; U.S. Pat. No. 5,488,746; U.S. Pat. No. 5,557,817; U.S. Pat. No. 5,572,757; U.S. Pat. No. 5,722,094; U.S. Pat. No. 5,852,827; U.S. Pat. No. 5,996,147; U.S. Pat. No. 6,009,576; U.S. Pat. No. 6,105,168; U.S. Pat. No. 6,243,896; U.S. Pat. No. 6,286,163; U.S. Pat. No. 5,148,560; W.I.P.O. Patent Document No. WO93/17606; Switzerland Patent Document No. CH 658177; Great Britain Patent Document No. GB 927094; and an article entitled "Self-Adhering Nylon Tapes" in the *Journal of AMA*, Oct. 18, 1958. Each of these related references have been considered with respect to one or more of the related cases of the inventor, as submitted in the aforementioned cross-referenced applications.

Therefore, it is desirable to have an infant bedding product which will function to keep an infant covered and warm, is as free as possible of suffocation hazards, is easy to use, is adjustable and will prevent an infant from moving into the prone sleeping position while still permitting some infant movement.

None of the above inventions and patents, taken either singly or in combination, is seen to describe the instant invention as claimed.

SUMMARY OF THE INVENTION

The crib safety sheet and blanket has a fitted sheet with a top surface, a bottom surface, and two opposing ends defining pockets for snugly fitting the sheet to a mattress. One end of at least two elastic straps is sewn to one side of the sheet. Hook and loop fastening material is attached to one side of the free end of each strap. Mating strips of hook and loop fastening material are attached to the other flat edge of the fitted sheet such that it may mate with the hook and loop fastening material on the straps. Attached to the center of the sheet is a rectangular blanket with a front surface and a back surface. The blanket is sewn along a longitudinal midline to the fitted sheet, defining two blanket halves which may be wrapped around an infant. Strips of hook and loop fastening material are attached to each half of the blanket so that the blanket may be fastened around the infant to retain the infant in a supine position while sleeping.

An infant may be placed on its back or side in the center of the blanket attached to the sheet. The edges of the blanket are folded over the infant with one edge lying on top of the other edge. The edges are removably attached to one another with mating pieces of hook and loop fastening material. When secured by the hook and loop fasteners, the blanket functions to completely encircle the infant from just under the infant's arm pits to well past the infant's toes. The blanket is fastened securely enough to insure that the infant cannot roll into the prone position, but not so securely so as to preclude all movement of the infant.

A convenience and a necessity for quickly removing the safety blanket for laundering is a feature of the instant application. This feature allows for more versatility and usability, especially in the arenas that involve the care of multiple infants, such as hospitals and daycare centers. The use of a removable blanket from the sheet allows for quick replacement of a soiled blanket with a clean blanket to maintain sanitary conditions within the environment. It is thereby an aspect of the instant invention to have a blanket separable from the sheet covering the sleep surface, via any of a myriad of attachments. In addition, it within the purview and scope of the invention to provide the blanket attached to a intermediary sheet member, wherein the intermediary sheet member is removably attached to the sheet covering the sleep surface.

These features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
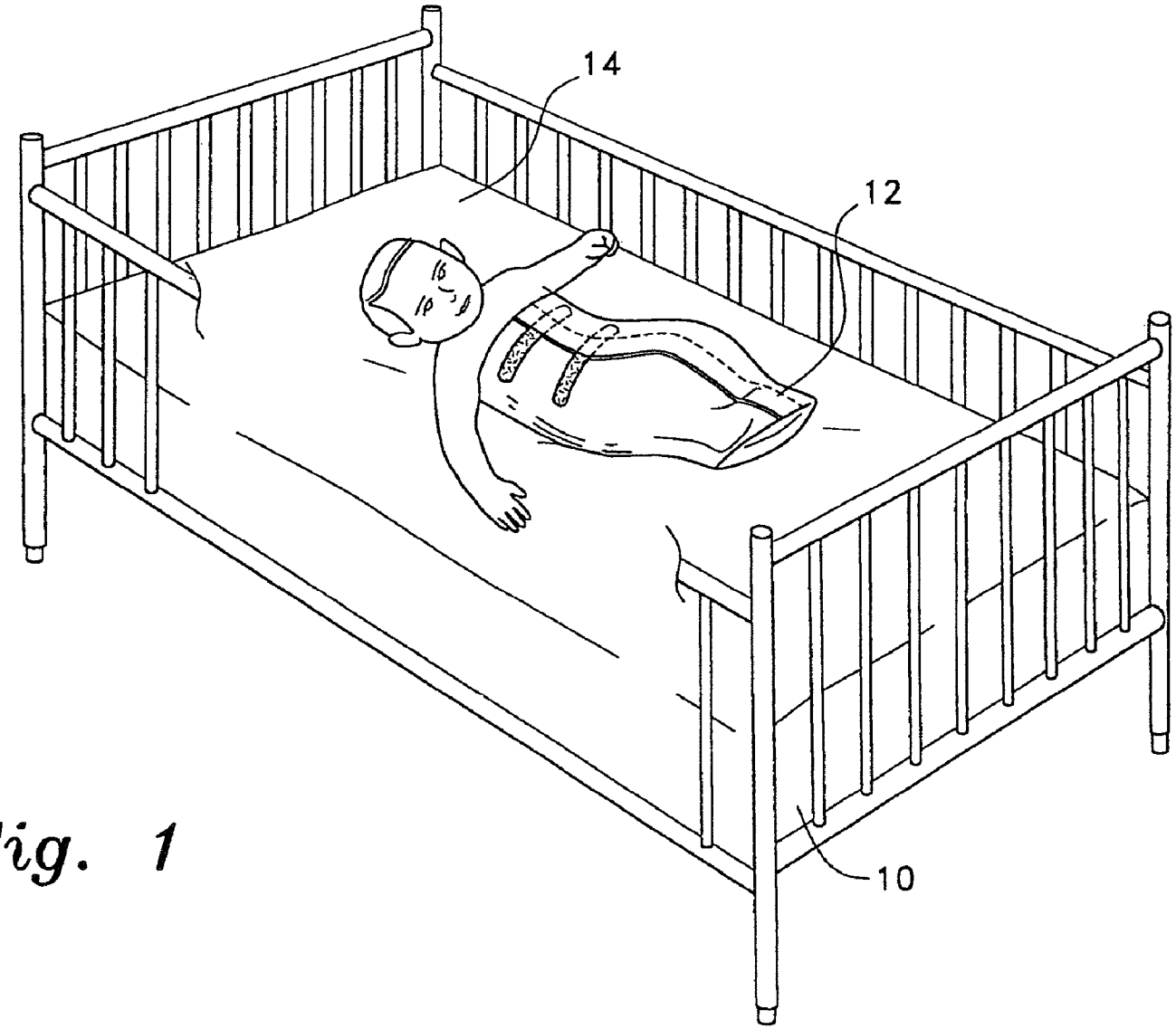
FIG. 1 is a fragmented, environmental, perspective view of a crib safety sheet and blanket according to the present invention with an infant secured in the blanket.

The present invention is an infant crib safety sheet and blanket 10 which, as seen in FIG. 1, is installed on a mattress in a crib, bassinet, or the like. The invention has a blanket portion 12 (blanket) with a front surface and a back surface. The blanket is attached to a fitted sheet portion 14. The blanket 12 is preferably sewn to the middle of the front surface of the fitted sheet 14 by stitching along the longitudinal midline of the blanket portion 12, defining two halves of the blanket which may be folded or wrapped about the infant. When in use, the blanket 12 is wrapped around an infant's torso and lower extremities (with one side overlapping the other side) so as to keep the infant warm and securely positioned in the center of the safety sheet and blanket 10 on its back or side. The blanket 12 is held in position around the infant with four mating strips of hook and loop fastening material (discussed below).

When secured in the safety sheet and blanket an infant retains full motion in its arms and head and some lateral motion but is unable to roll completely over or to extract itself from the blanket 12. By securing an infant in this manner there is a lower chance of sudden infant death syndrome, which is normally associated with infants sleeping in the prone position. The infant has no loose bedding materials upon which to suffocate, and the infant cannot kick free of its blanket and become cold during sleep.

Figure 2:
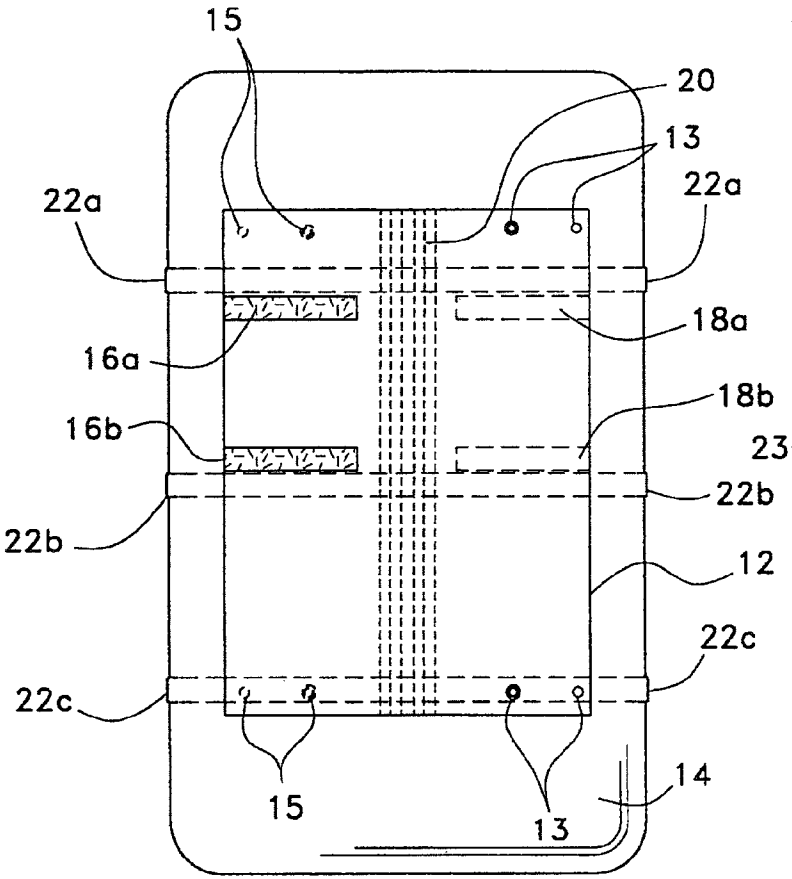
FIG. 2 is a top view of a crib safety sheet and blanket positioned around a mattress.

FIG. 2 is a top view of the safety sheet and blanket wrapped around a mattress with the blanket 12 laid flat against the sheet 14 and the back surface of the blanket 12 coming into contact with the front surface of the sheet 14. The stitching 20, which secures the blanket 12 to the sheet 14, can be seen in this view. The hook and loop fastening material 16*a*, 16*b* sewn to the front surface of the blanket 12 removably attaches to corresponding hook and loop fastening material 18*a*, 18*b* sewn to the back surface of the blanket 12. FIG. 2 shows two sets of mating hook and loop fasteners (16*a* with 18*a*, and 16*b* with 18*b*) but additional fastener strips may be attached and used if a more secure hold is required. FIG. 2 also shows the three elastic straps 22*a*-22*c* that wrap under the mattress (discussed below) to secure the flat edges of fitted sheet 14 to the mattress 24.

The blanket as seen in FIG. 2 may be adapted for smaller infants by folding the sides of the blanket to reduce the blanket's overall width. Preferably, the right side of the blanket would be folded toward the front surface of the blanket and fastened with snap fasteners 13 present thereon. The left side of the blanket would preferably be folded toward the back surface of the blanket and secured with snap fasteners 15 present thereon.

Figure 3:
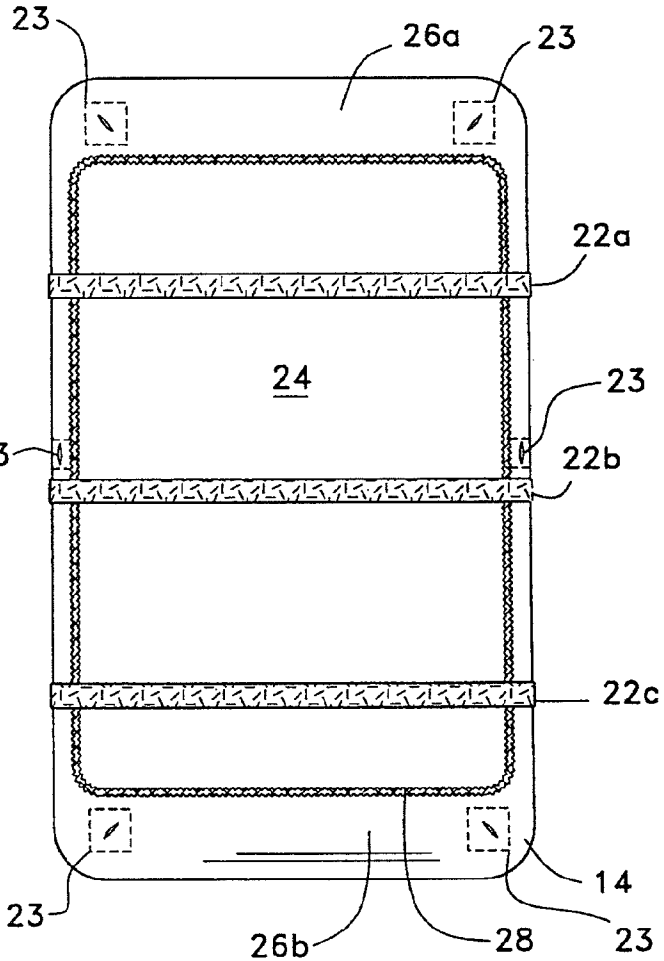
FIG. 3 is a bottom view of a crib safety sheet and blanket positioned around a mattress.

FIG. 3 is a bottom view of a safety sheet and blanket 10 wrapped around a mattress 24. This view shows the two pockets 26*a*, 26*b* defined in the fitted sheet 14 which secure the fitted sheet to the foot and head portions of a mattress 24. An elastic band 28 functions to keep the two pockets 26*a*, 26*b* securely wrapped around a mattress. Three elastic straps 22*a*, 22*b*, and 22*c* keep side edges of the fitted sheet 14 secured to the mattress. The sheet 14 may have several cloth reinforced grommets 23 dispersed along the sides the sheet. These grommets 23 may serve as anchor points for bungee cords or other suitable holding devices when securing the crib sheet and blanket combination to the bed frame of a large bed so that the crib safety sheet and blanket 10 may be used when a crib is not available, e.g., when traveling.

Figure 4:
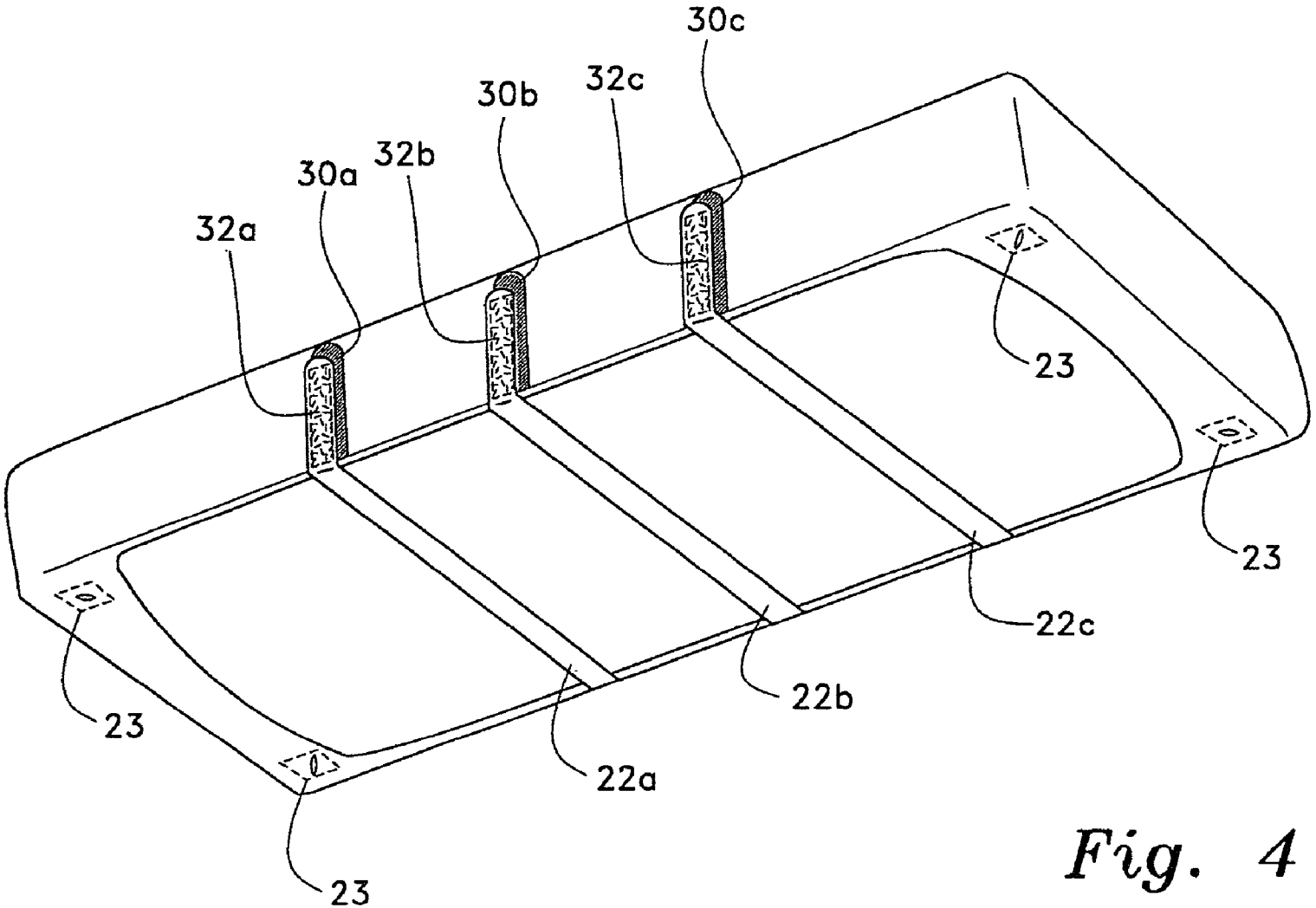
FIG. 4 is a perspective view of the bottom of a mattress equipped with an infant safety sheet and blanket.

FIG. 4 shows a perspective view of the bottom of safety sheet and blanket 10. The elastic straps 22*a*-22*c* are removably attached to one side of the fitted sheet 14, one strip of hook and loop fastening material 30*a*-30*c* for each strap 22*a*-22*c* being sewn to the fitted sheet 14 and a mating strip of hook and loop fastening material 32*a*-32*c* (seen in relief) being sewn to the elastic straps 22*a*-22*c*.

Figure 5:
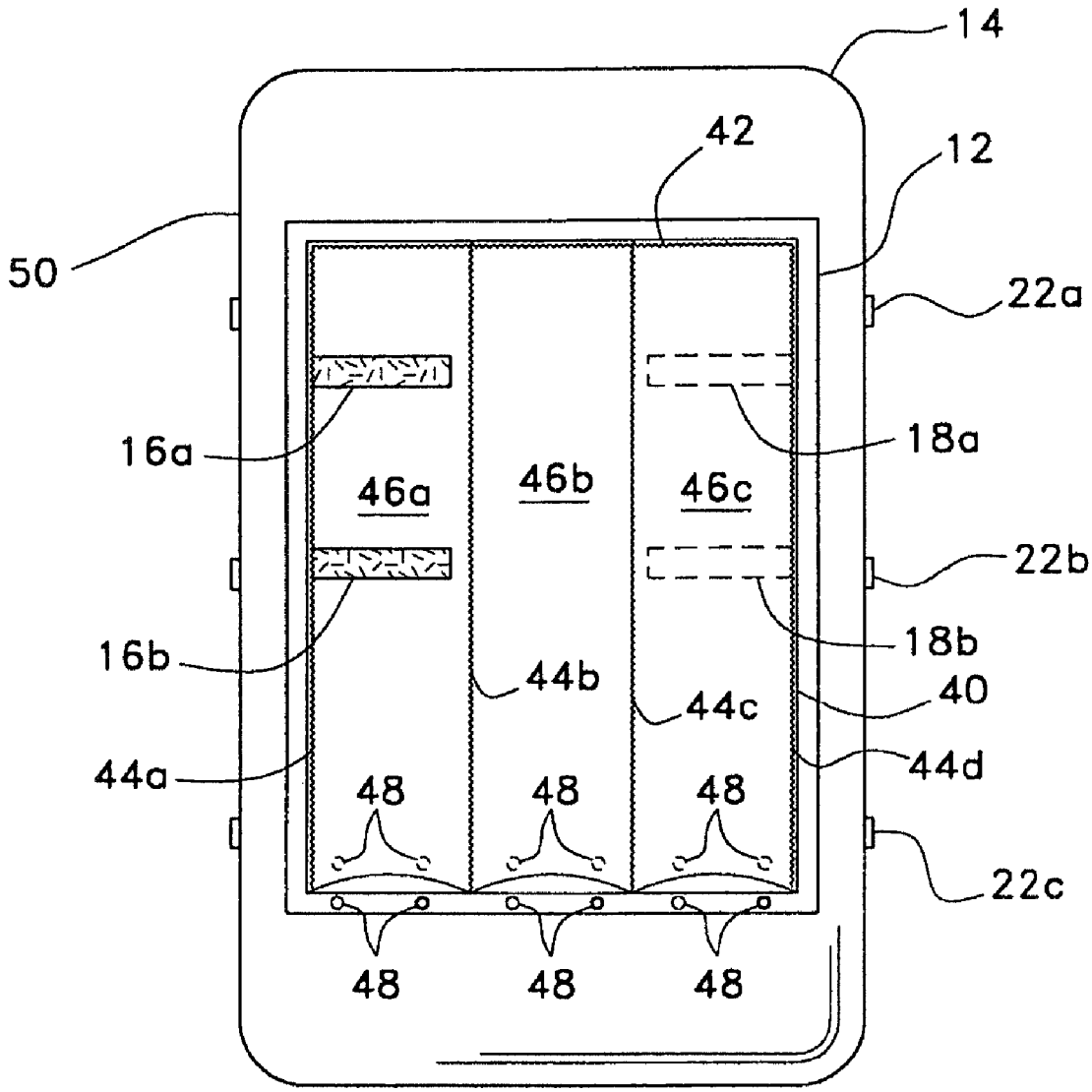
FIG. 5 is a top view of the safety sheet and blanket positioned around a mattress.

FIG. 5 shows a feature 50 of the safety sheet and blanket that is used for infants who need additional physical support while sleeping. This feature and all following features are similar to the first feature and the same reference numbers represent identical components. The second feature of the safety blanket/sheet combination has a second blanket 40 with a top and bottom surface that is attached to the first blanket 12. The first blanket 12 is shown larger in this figure for illustration purposes. One horizontal line of stitching 42 holds together the tops of both blankets and four vertical lines of stitching 44*a*-44*d* hold together the edges and the centers of the blankets. The four vertical lines of stitching 44*a*-44*d* also divide the blankets into three vertical sheaths 46*a*-46*c*. The bottoms of the sheaths 46*a*-46*c* may be closed using the snap fasteners 48 located on the bottom surface of the second blanket 40 and the top surface of the first blanket 12. Hook and loop fastening material, zippers, and any other fastening devices known to one skilled in the art may be substituted for the snap fasteners. Some of the hook and loop fastening material 16*a*, 16*b* has been moved in this feature to the top surface of the second blanket 40 from their position in the first feature on the top surface of the first blanket 12.

The second feature of the crib safety sheet and blanket combination is used in the same manner as the first feature except that supportive material such as egg-crate cushioning material or air pad-type material may be inserted into the sheaths 46*a*, 46*b*, 46*c*. Temperature regulating material such as hot and cold packs may also be inserted into the sheaths 46*a*, 46*b*, 46*c*. The supportive material is secured inside the sheaths by using the snap fasteners 48 located at the bottom of the sheaths.

The third, fourth and fifth features of the crib safety sheet and blanket will now be described. These features involve modifications to the fitted sheet. The third through fifth features may employ either the blanket 12 described in the first feature of FIGS. 1-4 or the double blanket 12, 40 design described in the second feature of FIG. 5. The following description describes modifications to the sheet and their use with only the first blanket 12 for clarity.

Figure 6:
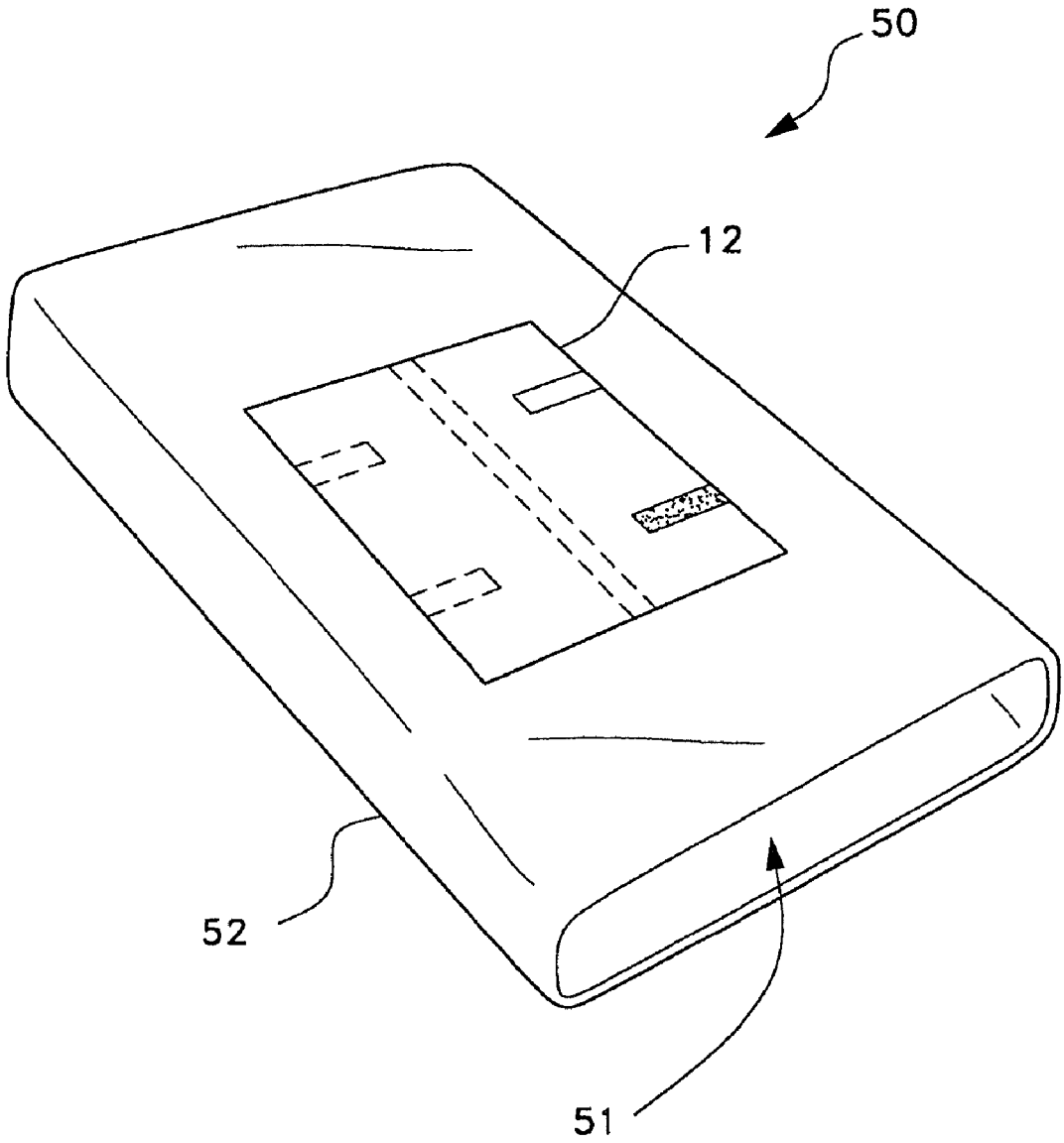
FIG. 6 is a top environmental perspective view of a feature of the present invention.

A third feature 50 of the present invention, as shown in FIG. 6, replaces the fitted sheet of the first feature with a cloth sack 52 or case generally resembling an enlarged pillow case. The sack 52 has a top surface, bottom surface and at least one opening 51, the top surface being formed by a sheet as an integral part of the sack 52. Bedding material such as a bassinet pad or a small mattress is ordinarily inserted into the sack 52 through the at least one opening 51. The blanket 12 is sewn to the top surface of the sack 52 in the same manner that the blanket 12 is attached to the fitted sheet 14. In all other respects the blanket 12 is identical to the first feature, and will not be described further. Although the sack 52 is shown having the opening 51 at one end thereof, it is well within the purview of this invention that the opening 51 extends either along the side, or across the bottom (e.g., a sham). In this feature, the majority of the bedding material is enveloped by the sack 52.

Figure 7:
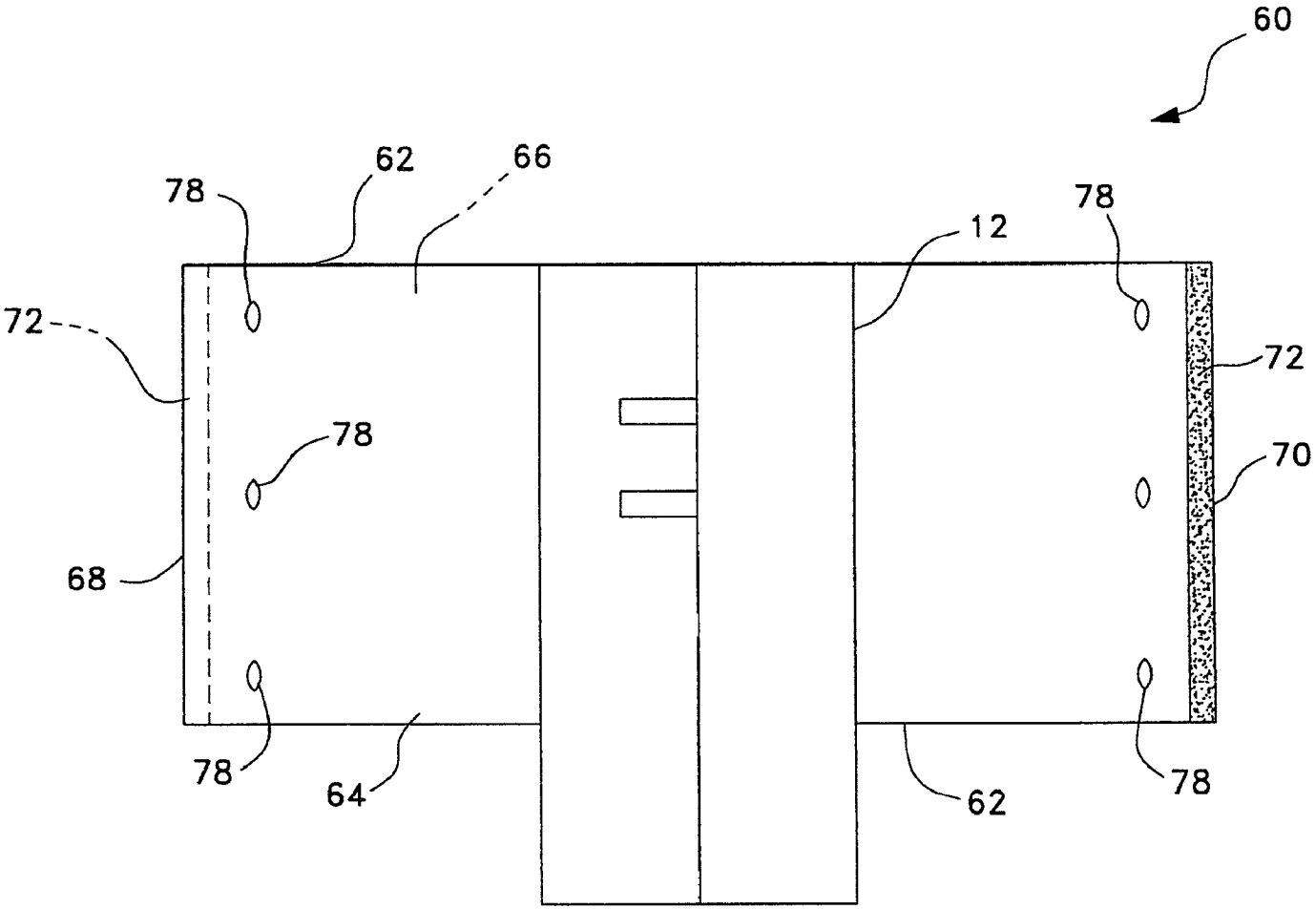
FIG. 7 is a top view of a feature of the present invention.

A fourth feature 60 of the present invention is illustrated in FIG. 7. This feature 60 substitutes a preferably rectangular sheet 62 of material in place of the fitted sheet 14 of the first feature. The sheet 62 has a front surface 64, back surface 66, a top edge, a bottom edge, a left edge 68 and a right edge 70. A fastening device such as hook and loop material 72 is disposed upon both the right 70 and left 68 edges. Snap fasteners or any other suitable fastening devices may also be used in place of the hook and loop material. The sheet 62 further has plurality of apertures 78 defined between its front 64 and back 66 surfaces. The apertures 78 are preferably located close to, and parallel to, the right 70 and left 68 edges. However, placement of the apertures 78 near the edges 68 and 70 of the sheet is not a critical aspect of the invention, and the apertures 78 may be more centrally located as discussed below. As in the third feature, the blanket 12 is sewn to the front surface 64 in the same manner as the blanket 12 is attached to the fitted sheet 14, and is identical in all other respects to the blanket 12 of the first feature, and will not be described further.

Figure 8:
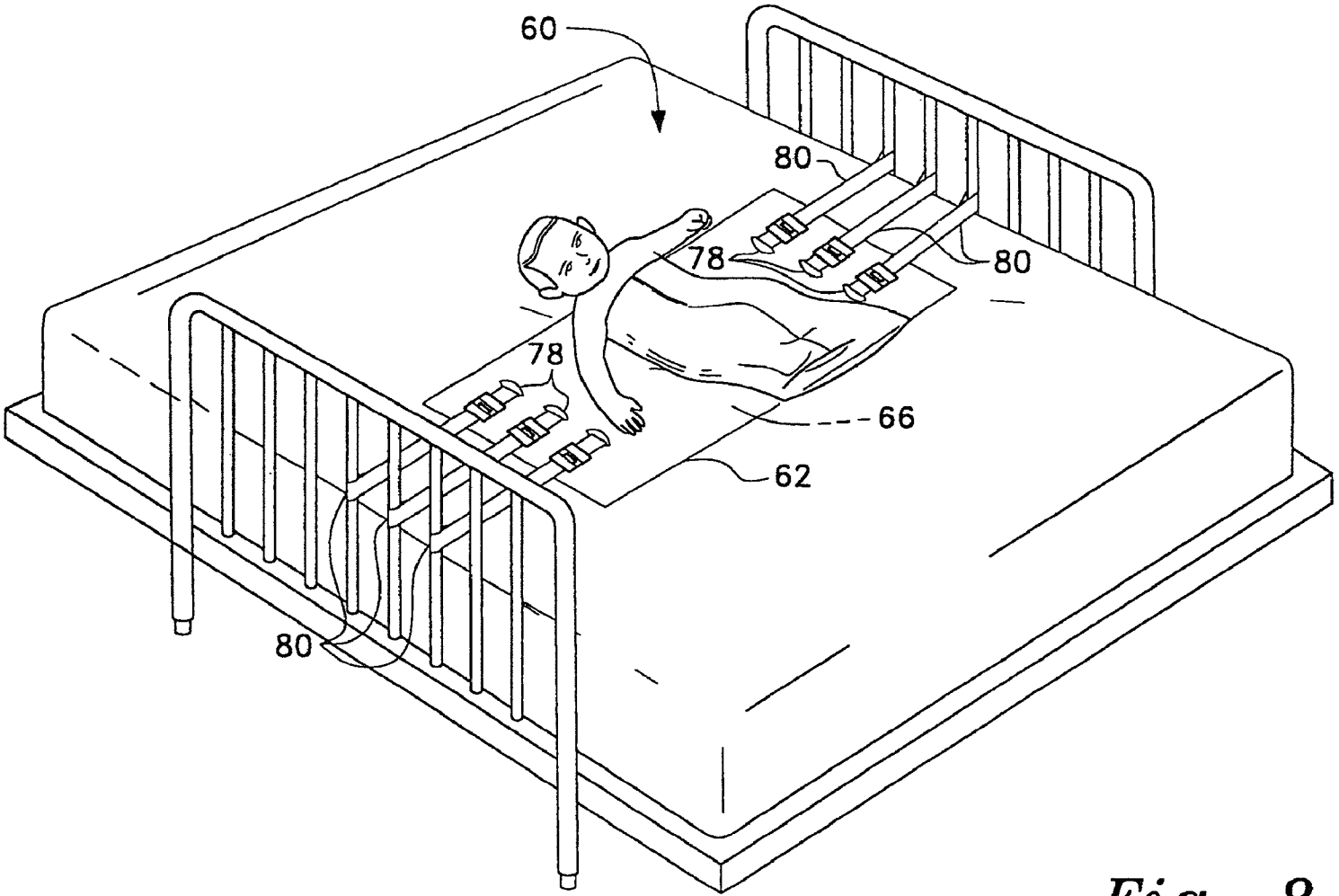
FIG. 8 is an environmental perspective view of a feature of the present invention.

The fourth feature 60 may be used as illustrated in FIG. 8 on a full size adult mattress. The sheet 62 is placed back surface 66 down on the top surface of a mattress. Adjustable straps 80 are looped through the apertures 78 and through posts on the bed frame or an accessory guard rail in order to secure the sheet 62 to the mattress. It is well within the ability of one skilled in the art to design a wide range of suitable apertures 78 ranging from cloth reinforced slits to metal or plastic reinforced rings. It must be noted, however, that any apertures containing hard or uncomfortable materials should be located more centrally on the sheet so as not to become uncomfortable to an infant when the invention is used on crib pads or bassinets as discussed below.

Figure 10:
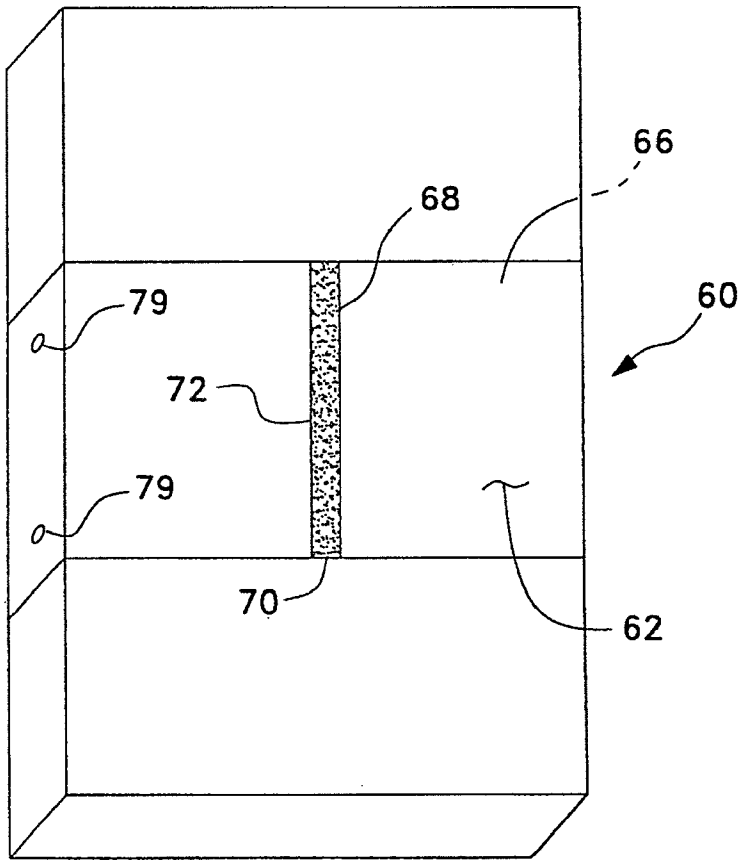
FIG. 10 is a bottom environmental perspective of a feature of the present invention.
Figure 9:
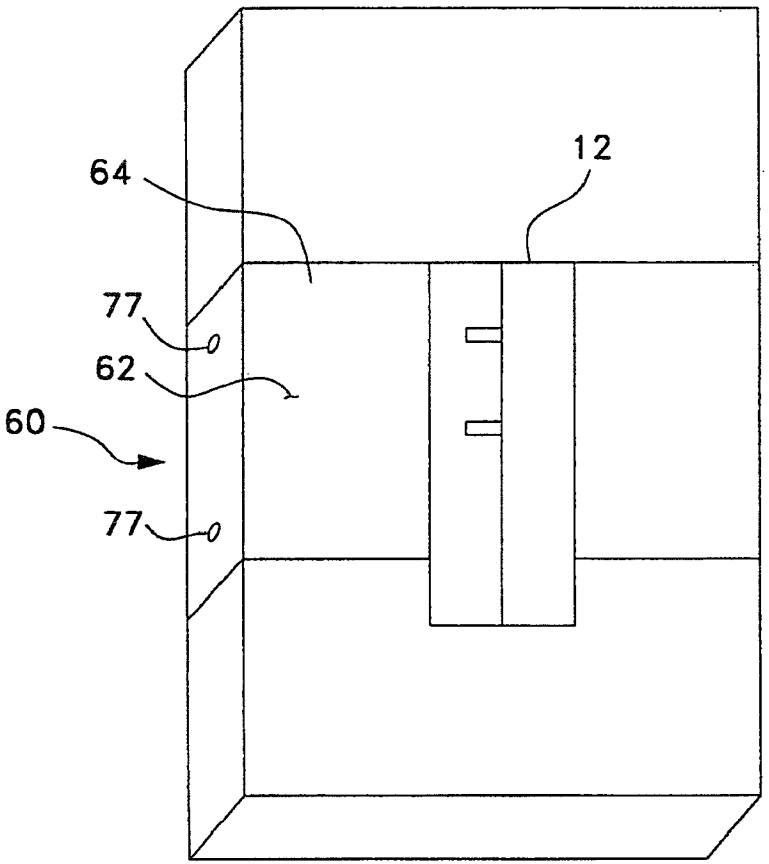
FIG. 9 is a top environmental perspective of a feature of the present invention.

The fourth feature 60 may also be used on smaller bedding materials, such as a crib mattress, as shown in FIGS. 9 and 10. For these smaller applications the sheet 62 is wrapped completely around the mattress approximately midway between the head and foot of the mattress, with the back surface 66 of the sheet 62 coming into contact with the mattress. The left 68 and right edges 70 of the sheet are secured to one another using the aforementioned hook and loop material 72.

The fourth feature may also be used on even smaller bedding material such as a bassinet pad. First, the left 68 and right 70 edges of the sheet are attached to one another as detailed above, but without the intervening mattress. The double thickness sheet 62 is then wrapped around a bassinet pad or the like. The sheet 62 is then secured in position by connecting fasteners 77 to fasteners 79.

Figure 11:
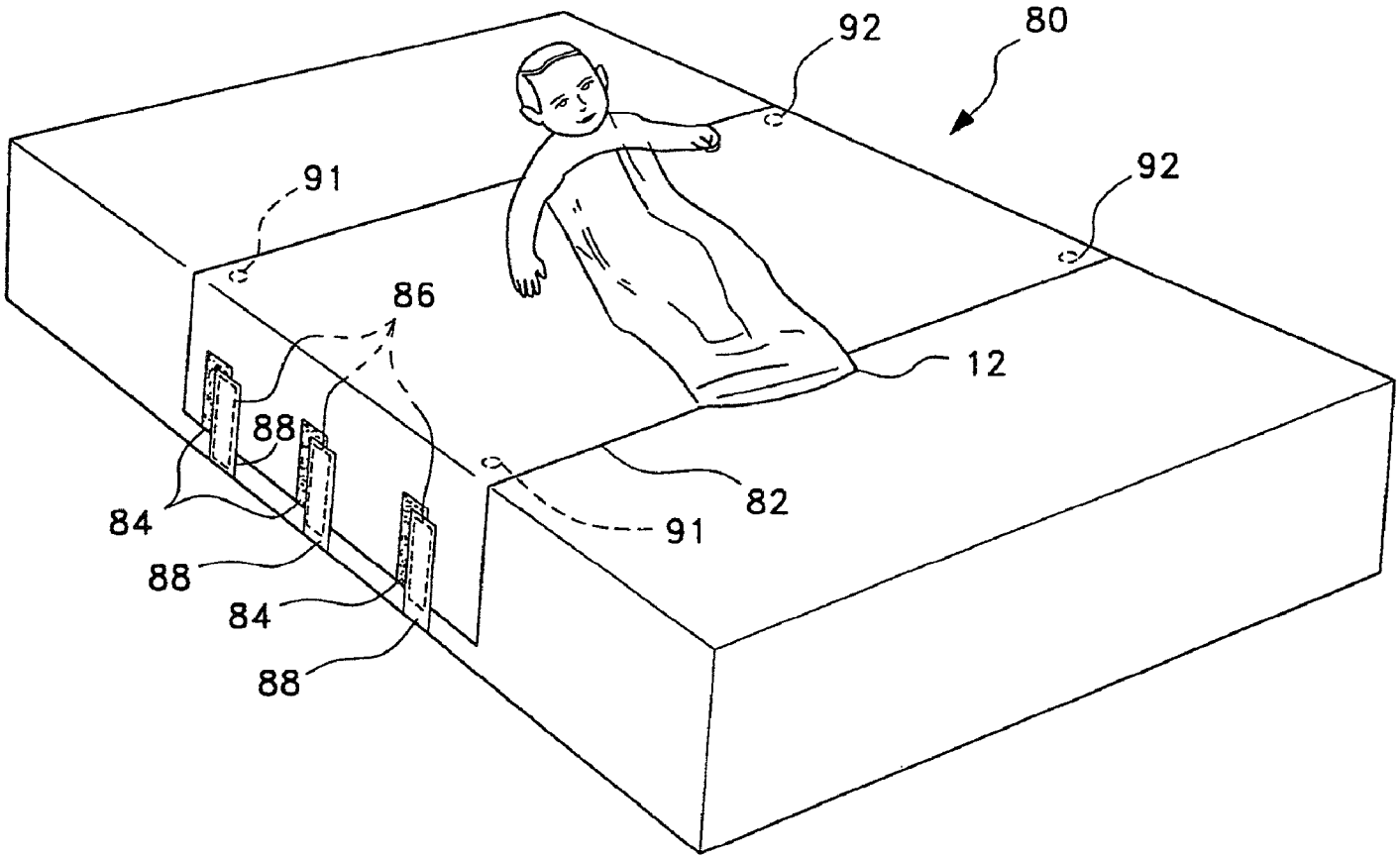
FIG. 11 is a top environmental perspective of a feature of the present invention.
Figure 12:
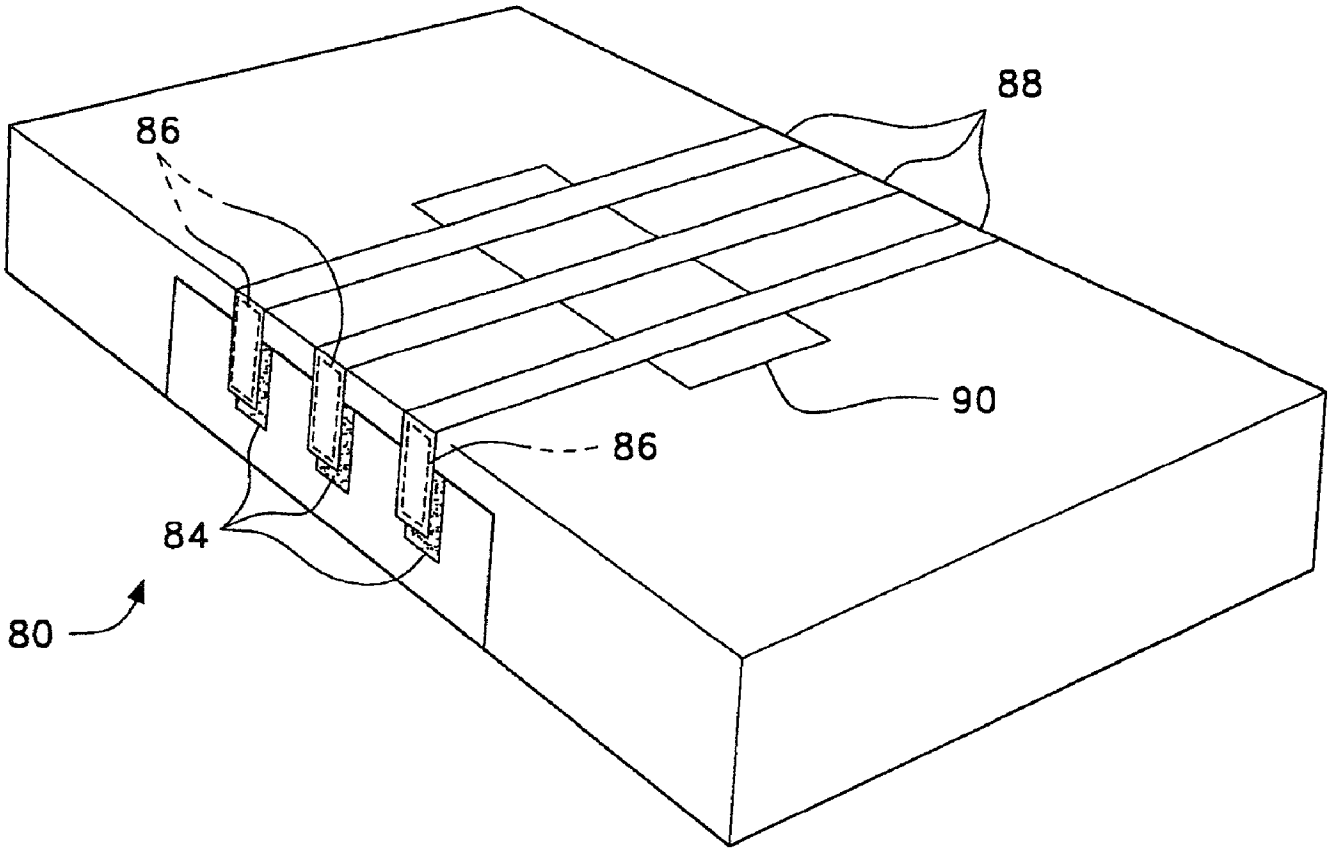
FIG. 12 is a bottom environmental perspective of a feature of the present invention.

A fifth feature 80 of the present invention, as illustrated in FIGS. 11 and 12, uses the blanket 12 of the first feature but substitutes a generally rectangular sheet 82 for the fitted sheet 14 of the aforementioned feature. The sheet 82 has a front surface, back surface, and two opposing ends. Disposed adjacent to each opposing edge are several sections of hook and loop material 84.

Several straps 88 have one end attached to the sheet 82 and are wrapped around beneath the mattress or crib frame, having a second end with corresponding sections of hook and loop material 86 which are releasably attachable to the aforementioned hook and loop material 84 on the sheet 82. Hook and loop material is the preferred method of strap attachment but any suitable method including but not limited to, buttons, snaps and buckles may also be used. The straps 88 themselves preferably have elastic properties, but any suitable strap may be used. Each of the straps 88 is attached to or threaded through a spacer 90. The spacer 90 is a flat, generally rectangular sheet which serves to hold the straps and keep the straps 88 properly positioned and oriented. In use, the spacer will be disposed beneath the mattress. The fifth feature 80 also has two sets of corresponding fasteners 91, 92. Fasteners 91 are designed to attach to opposing fasteners 92 and in so doing reduce the overall size of the sheet 82 and thereby prepare the apparatus for smaller size bedding materials.

Figure 19:
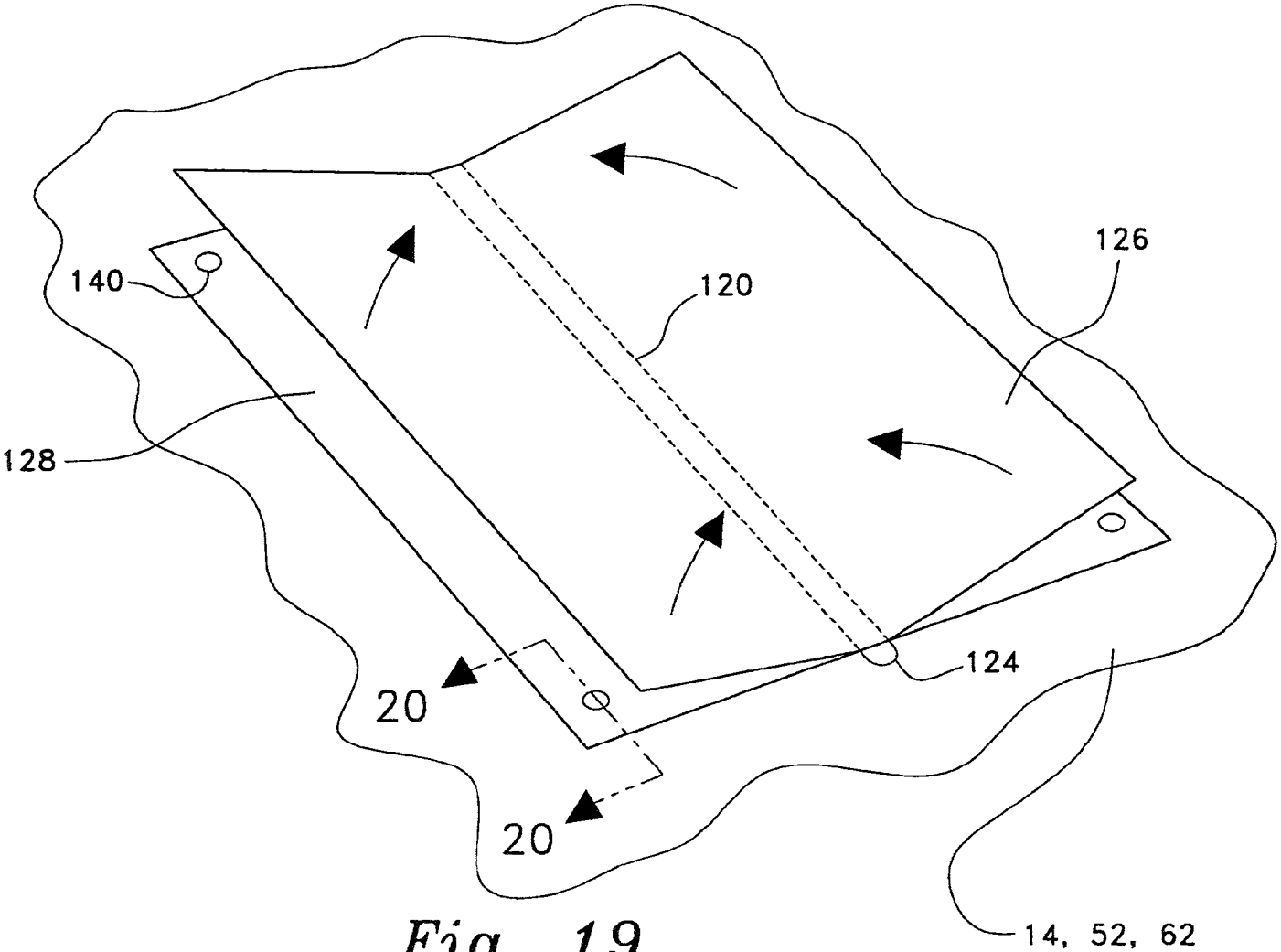
FIG. 19 is an enlarged, elevational, perspective view of a safety sheet and blanket illustrating a feature of the present invention.
Figure 20A:
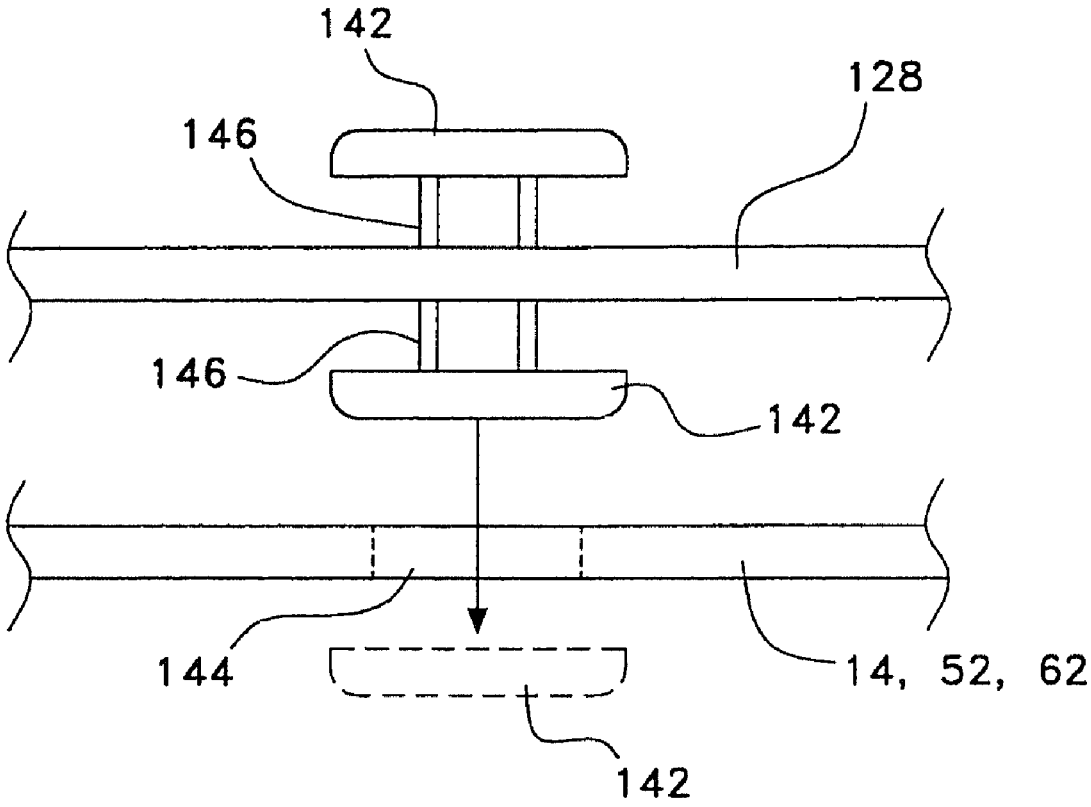
FIGS. 20A through 20D are cross-sectional views along 20-20 of FIG. 19.

According to the features of the invention, it is clear that the application of the safety sheet and blanket has a need for removability (without sacrificing the safety of the infant when wrapped therein). Therefor, a safety sheet and detachable blanket is shown in FIGS. 13-20D. The safety sheet and detachable blanket, referring to FIGS. 13, and 14, correspond to FIG. 2. The safety sheet and detachable blanket, referring to FIGS. 16, and 17, correspond to FIG. 6. The safety sheet and detachable blanket, referring to FIG. 19, corresponds to FIG. 9. FIGS. 19-20D further illustrate the detachable blanket with respect to FIGS. 14, and 17.

Figure 13:
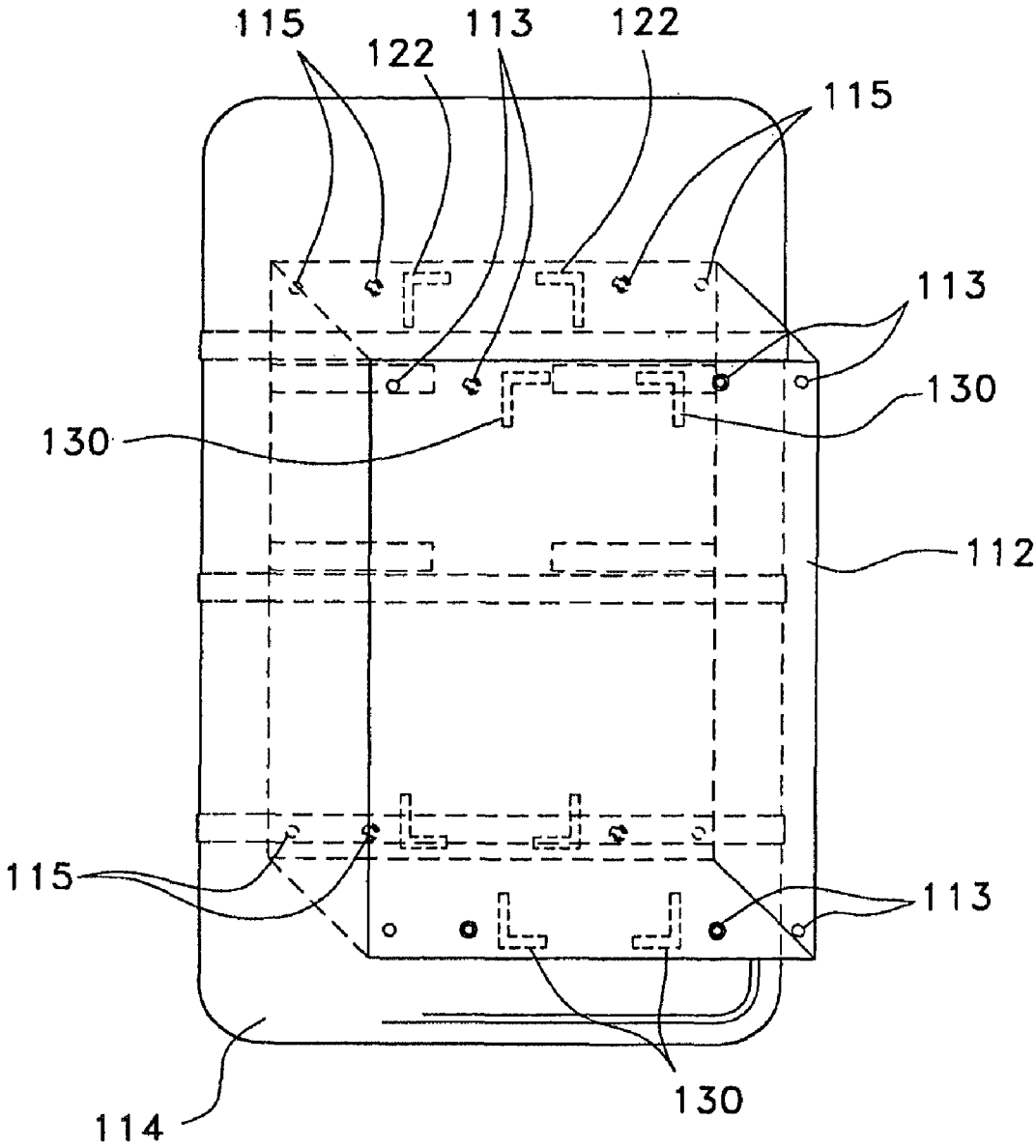
FIGS. 13 and 14 are top views of a safety sheet and blanket, similar to FIG. 2, according the present invention.
Figure 16:
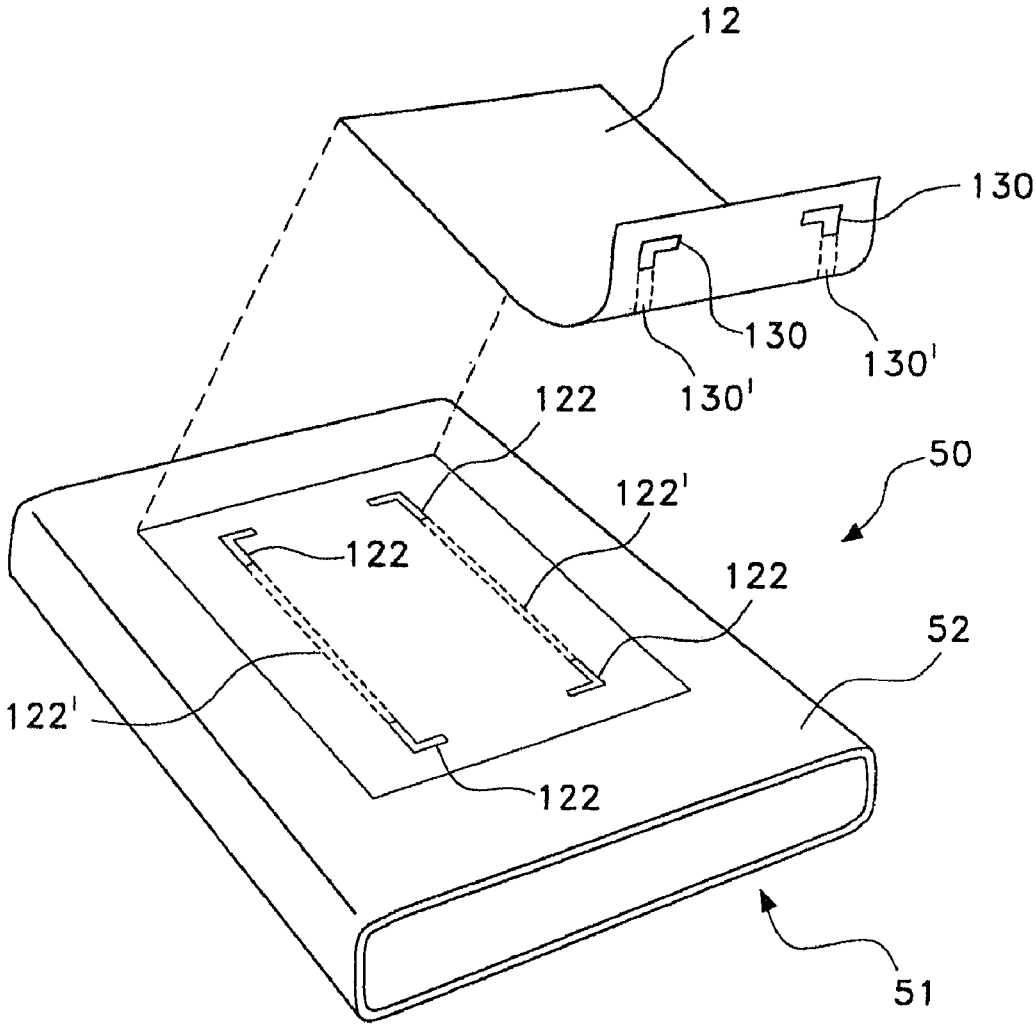
FIGS. 16 and 17 are exploded perspective views of a safety sheet and blanket, similar to FIG. 6, having a feature of the present invention.
Figure 18:
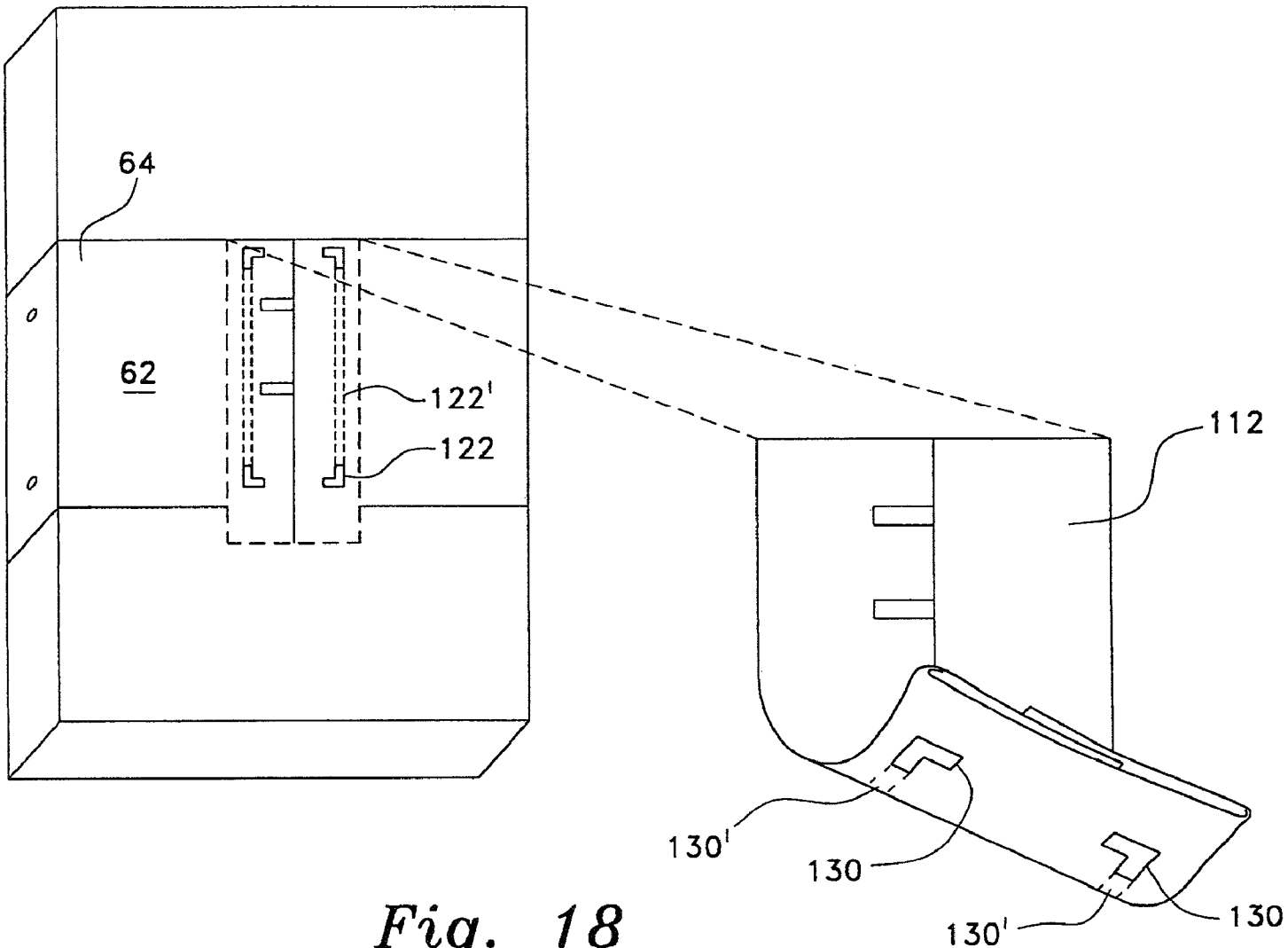
FIG. 18 is an exploded view of a safety sheet and blanket, similar to FIG. 9, having a feature of the present invention.

Referring to FIGS. 13, 16, and 18, a safety sheet and detachable blanket is shown in general. With respect to FIG. 13, the sheet 14 (see FIG. 2) is provided with the detachable blanket 112, the features of detachable blanket 112 are the same as blanket 12 of FIG. 2, however the bottom of blanket 112 is provided with a first portion of a mating fastener 130, for engaging the corresponding second portion of the mating fastener 122. In this arrangement, the mating fastener portions 130, 122 provide the blanket 112 with a convenience element, for example, allowing the blanket 112 to be removed for laundering when soiled. The mating fasteners portions 130, 122 are, for example, hook and loop type fasteners (i.e., Velcro®).

The fastener portions 130, 122 are shown as being L-shaped however, it is within the purview of the invention to provide the fasteners with several other arrangements. As seen in FIG. 13, fasteners 130', 122' (in phantom) illustrate an arrangement having a pair of elongated strips attached to the bottom of the detachable blanket 112, and the top of the sheet 14, respectively. Although, the mating portions of fasteners 130, 122 (130', 122') are shown in particular arrangement, it is understood that any arrangement, and location of the fasteners 130, 122 (130', 122') so as the function of allowing an infant to rest comfortably upon the blanket 112, and be wrapped in the blanket 112 (as seen in FIG. 1) in order to maintain the infant in the supine position. In addition, fasteners 113, 115, provide the same function of the fasteners 13, 15 of FIG. 2.

In FIG. 16, similar to FIG. 6, a cover 52, for a sleep surface, is shown having top and bottom surfaces. The top and bottom surfaces are joined together around the perimeter, so as to define an opening 51. The cover 52 envelopes the sleep surface, as discussed above, with respect to FIG. 6. The detachable blanket 12 is removably attached to the top surface of the cover 52 via mating fasteners 130, 122 (130', 122'), as discussed above with respect to FIG. 13. Although the sack 52 is shown having the opening 51 at one end thereof, it is well within the purview of this invention that the opening 51 extends either along the side, or across the bottom (e.g., a sham). In this feature, the majority of the bedding material is enveloped by the sack 52.

Referring to FIG. 18, similar to FIG. 9 and having corresponding components, a flat sheet 62 is shown, having a top surface 64. The top surface 64 is provided with the fastener portions 122 (122') for engaging the mating fastener portions 130 (130') the bottom surface of the detachable blanket 112. As discussed above, with respect to FIGS. 13, and 16, the mating fasteners 130, 122 (130', 122') are typically hook and loop type fasteners (i.e., Velcro®), however, any other suitable fasteners are useable so long as not to interfere with the comfort of the infant when wrapped and secured in the detachable blanket 112.

Turning to FIGS. 14, 15A, 15B, and 17, an alternative variation of the present invention for providing a detachable safety blanket is illustrated. In these figures, as the case of FIGS. 13, 16, and 18 above, common corresponding elements have the same reference numerals.

Figure 14:
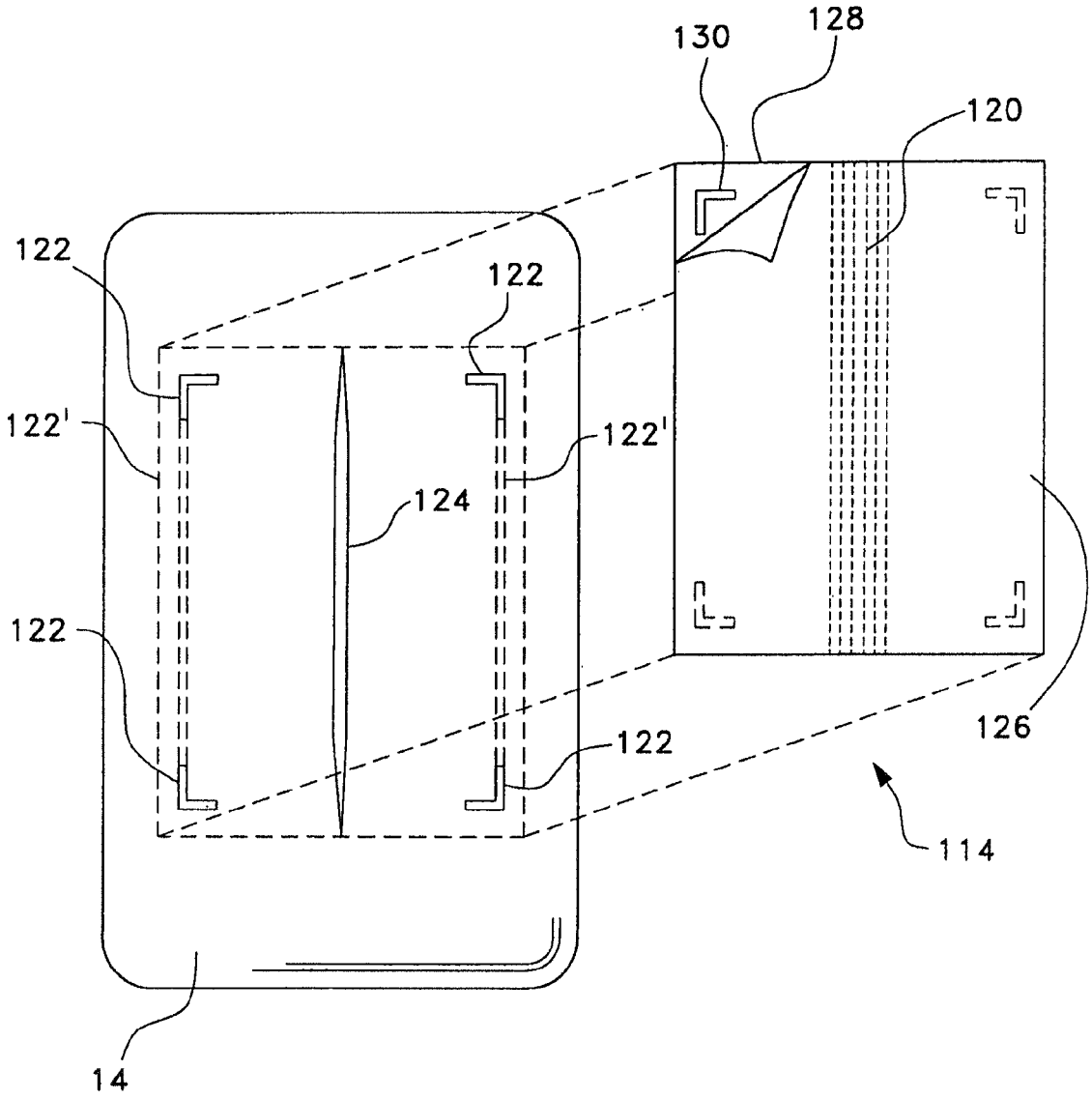
Figure 15A:
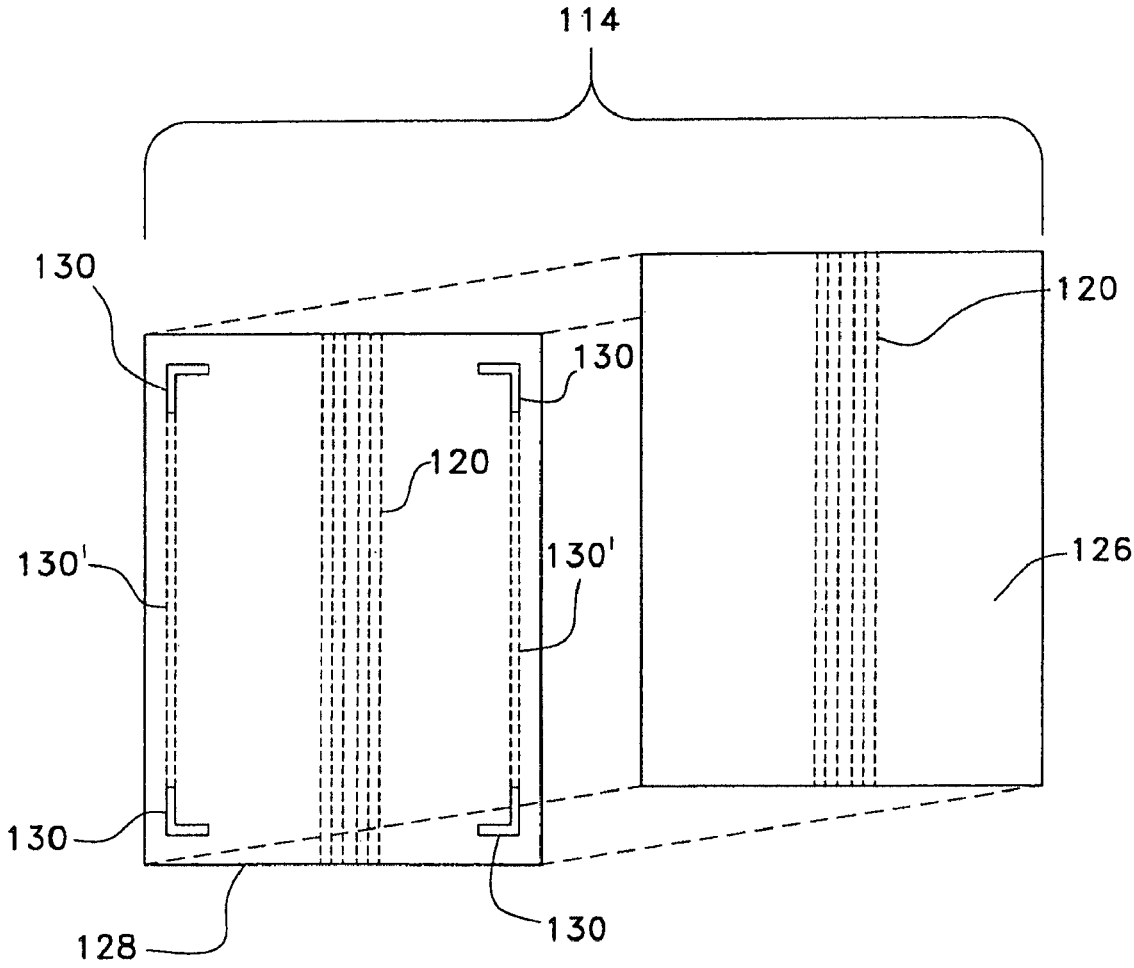
FIGS. 15A and B are exploded perspective views of the sheet and the blanket and sheet member of FIG. 14, according to the present invention.
Figure 15B:
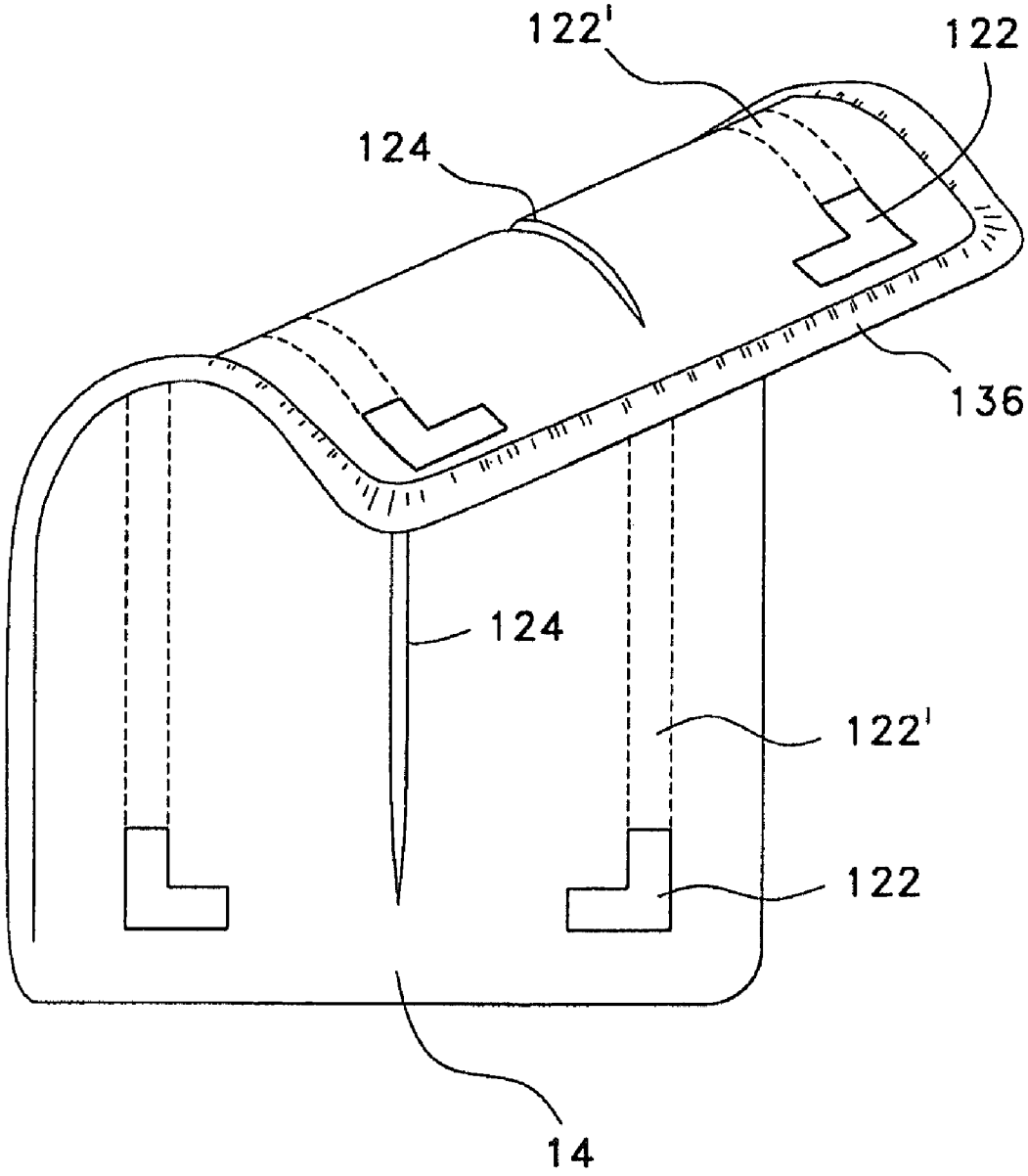

FIG. 14, shows a detachable blanket 126, as in FIG. 13, with an added sheet material 128 permanently secured to the bottom of detachable blanket 126. FIGS. 15A and 15B are exploded presentations of FIG. 14, to more clearly illustrate this aspect of the instant invention. The detachable blanket 126 is shown attached to the sheet material 128 via stitching 120. Stitching 120 is the same as the stitching 20 of FIG. 2. Although, the stitching 120 is shown along the midline of the blanket 126, it is understood that the stitching may be disposed in any manner so as to allow the blanket 126 to wrap and secure an infant therein. The sheet material 128 is selected any fabric type, and has the fasteners 130 disposed thereon. It is desired to have the detachable blanket 126 to be as versatile as possible. In that manner, the fastener portions 130 are disposed about the sheet material 128, and on both the upper and lower surfaces thereof.

Sheet 14, likewise has the mating fastener portions 122 disposed thereon in a mirror image fashion to the sheet material 128. In addition, the fastener portions 122 are likewise disposed on both the upper and lower surfaces of the sheet 14. Sheet 14 is further provided with an opening 124, such as slit. The opening 124 allows the sheet material 128 to be maneuvered to therethrough. In this manner, the fastener portions 130 on the upper surface thereof may engage the corresponding fastener portions 122 on the lower surface of the sheet 14 (see FIG. 15B). The sheet 14 includes an optional elasticized perimeter 136, thus more commonly referred to as a fitted sheet form. The omission of the elasticized perimeter 136 would result in the sheet 14 being a standard flat sheet form. In addition, the fastener portions 122 on lower surface allow for the reversibility of the sheet 14 on the sleep surface (not shown) in each of the flat and fitted forms.

In addition, as in FIG. 13, the disposition of the mating fastener portions 130, 122 are not limited the arrangement shown in FIG. 14, but any suitable arrangement is well within the scope of the invention. As such, mating fastener portions 130', 122' are likewise illustrated as elongated strips. The mirroring of fastener portions 122' to that of 130' is the same as for the fastener portions 130, 122. The mating fastener portions 130, 122 (130', 122') are preferably hook and loop fasteners (i.e., Velcro®), however, any suitable fastener is useable in this arrangement so long as the disposition thereof does not create any discomfort to the infant wrapped in the blanket 112.

Figure 17:
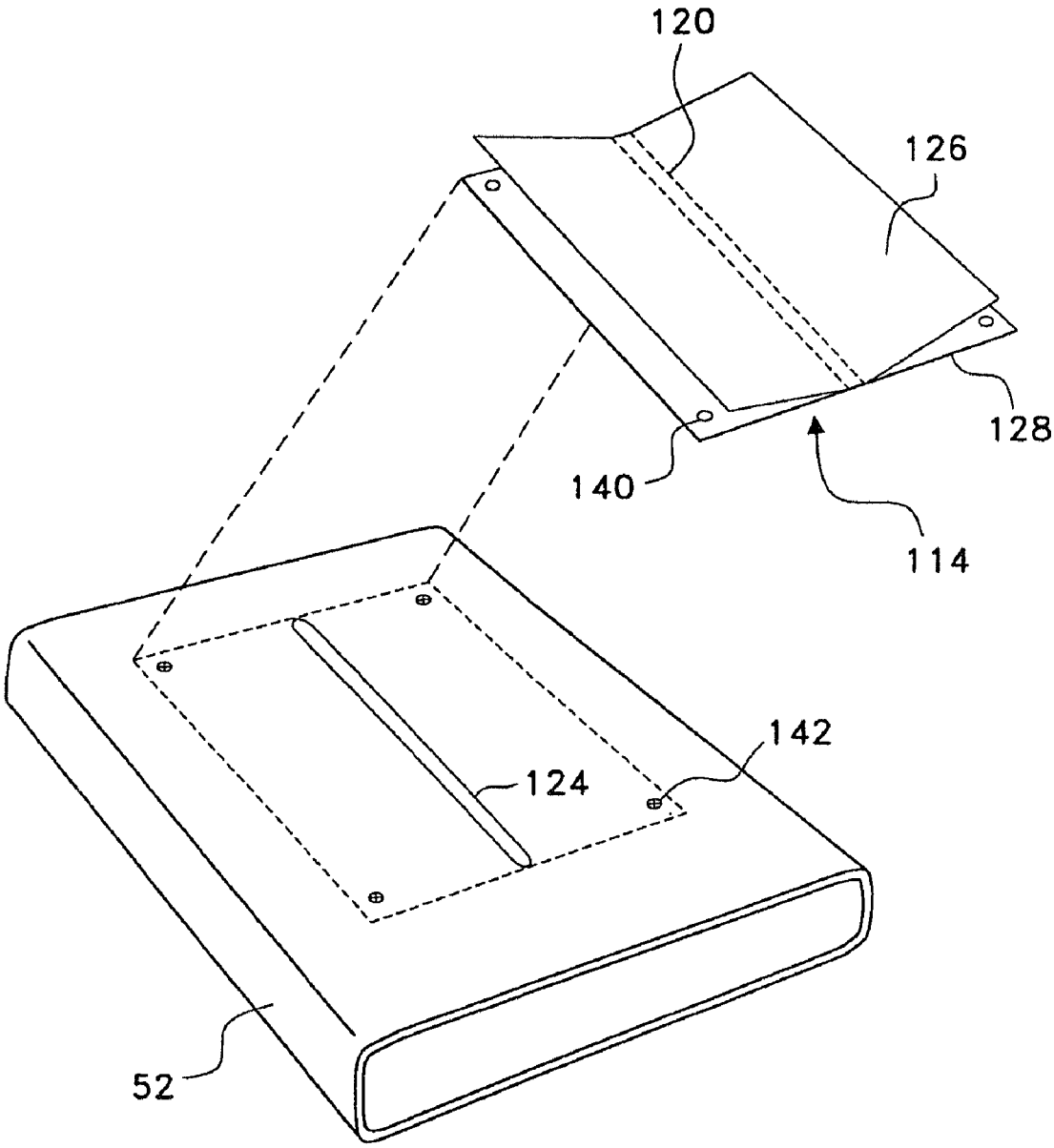

FIG. 17, combines the structures of sheet 52 from FIG. 6 and the detachable blanket 114 of FIG. 14. As shown in FIG. 16 above, a sheet, sack, or cover 52, for a sleep surface, is shown having top and bottom surfaces. The top and bottom surfaces are joined together around the perimeter, so as to define an open end 51. The cover 52 envelopes the sleep surface, as discussed above, with respect to FIG. 6. the cover 52 includes the opening 124 in the top surface thereof. Although the cover 52 is shown having the opening 51 at one end thereof, it is well within the purview of this invention that the opening 51 extends either along the side, or across the bottom (e.g., a sham). In this feature, the majority of the bedding material is enveloped by the cover 52.

The detachable blanket 126 is shown attached to the sheet material 128 via stitching 120. Stitching 120 is the same as the stitching 20 of FIG. 2. Although, the stitching 120 is shown along a midline of the blanket 126, it is understood that the stitching may be disposed in any manner so as to allow the blanket 126 to wrap and secure an infant therein. The sheet material 128 is selected any fabric type, and has the fasteners 130 disposed thereon. It is desired to have the detachable blanket 126 to be as versatile as possible. In that manner, the fastener portions 140 are disposed about the sheet material 128, and on both the upper and lower surfaces thereof.

Sheet 52, likewise has the mating fastener portions 142 disposed thereon in a mirror image fashion to the sheet material 128. In addition, the fastener portions 142 are likewise disposed on both the upper and lower surfaces of the sheet 52. Sheet 52 is further provided with the opening 124. The opening 124 allows the sheet material 128 to be maneuvered to therethrough. In this manner, the fastener portions 140 on the upper surface thereof may engage the corresponding fastener portions 142 on the lower surface of the sheet 52 (e.g., see FIG. 15B).

FIG. 19 is a partial enlarged portion of any FIGS. 14, 15A and 15B, and 17, illustrating the mating fastener arrangement according to the present invention. The detachable blanket 126 coupled to a sheet portion 128 via stitching 120. The attachment allows at least two sides of the blanket 126 that are wrapped around the infant (as indicated by the arrows), note FIG. 1. The detachable safety blanket 126 is securely and removably attached to the sheet (or sleep surface cover) 14, 52, 62, via a mating fastener arrangement 140 between the sheet material portion 128 and the sheet 14, 52, 62. The mating fastener arrangement 140, includes the hook and loop type fasteners 130, 122 (130', 122') discussed above, or any other suitable mating fastener types. FIGS. 20A, 20B, 20C, 20D, are cross-sectional views of a few examples of the myriad of fastener types 140 suitably used to secure the detachable blanket 126 to the sheet 14, 52, 62.

The sheet 14, 52, 62 includes a opening 124 for positioning the sheet material 128, so as to extend therethrough, as discuss above. Sheet material 128 has a one portion of the fastener 140, and the sheet 14, 52, 62 has the other portion. FIG. 20A illustrates a first example of the fastener types 140. Sheet material 128 has buttons 142 attached to the upper and lower surfaces thereof via coupling material 146 (e.g. thread). Sheet 14, 52, 62 includes a button hole 144 defined therethrough. In this arrangement, the sheet material 128 is disposable on the either upper or lower surface of the sheet 14, 52, 62, and is secured by passing a button 142 through the button hole 144.

Figure 20B:
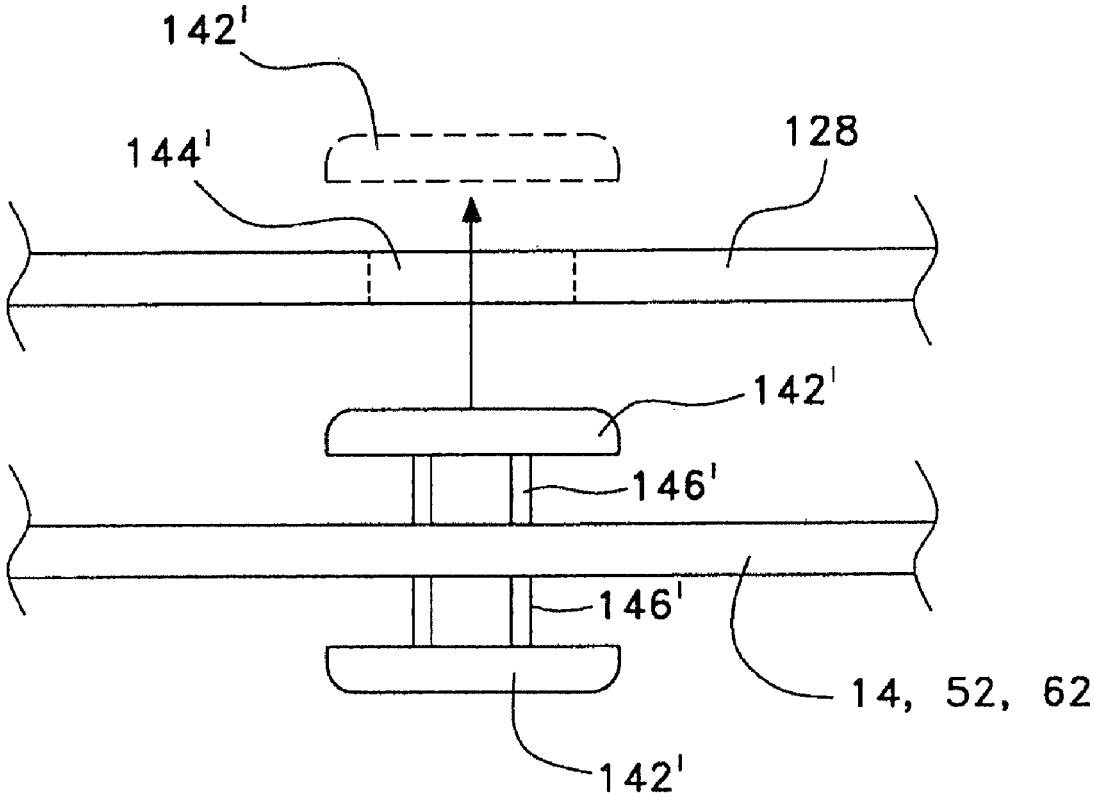

FIG. 20B illustrates a second example of the fastener types 140. Sheet material 128 has a button hole 144' defined therethrough. Sheet 14, 52, 62 has buttons 142' attached to the upper and lower surfaces thereof via coupling material 146' (e.g. thread). In this arrangement, the sheet material 128 is disposable on the either upper or lower surface of the sheet 14, 52, 62, and is secured by passing a button 142' through the button hole 144'.

Figure 20C:
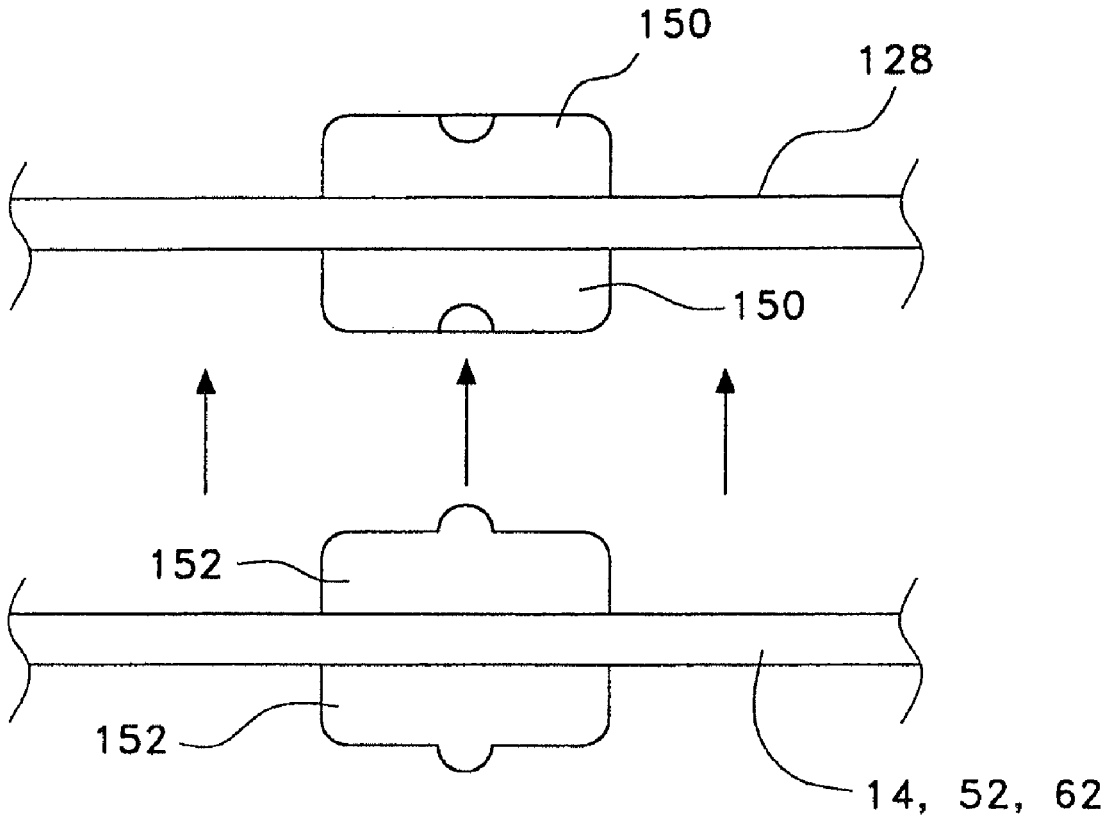
Figure 20D:
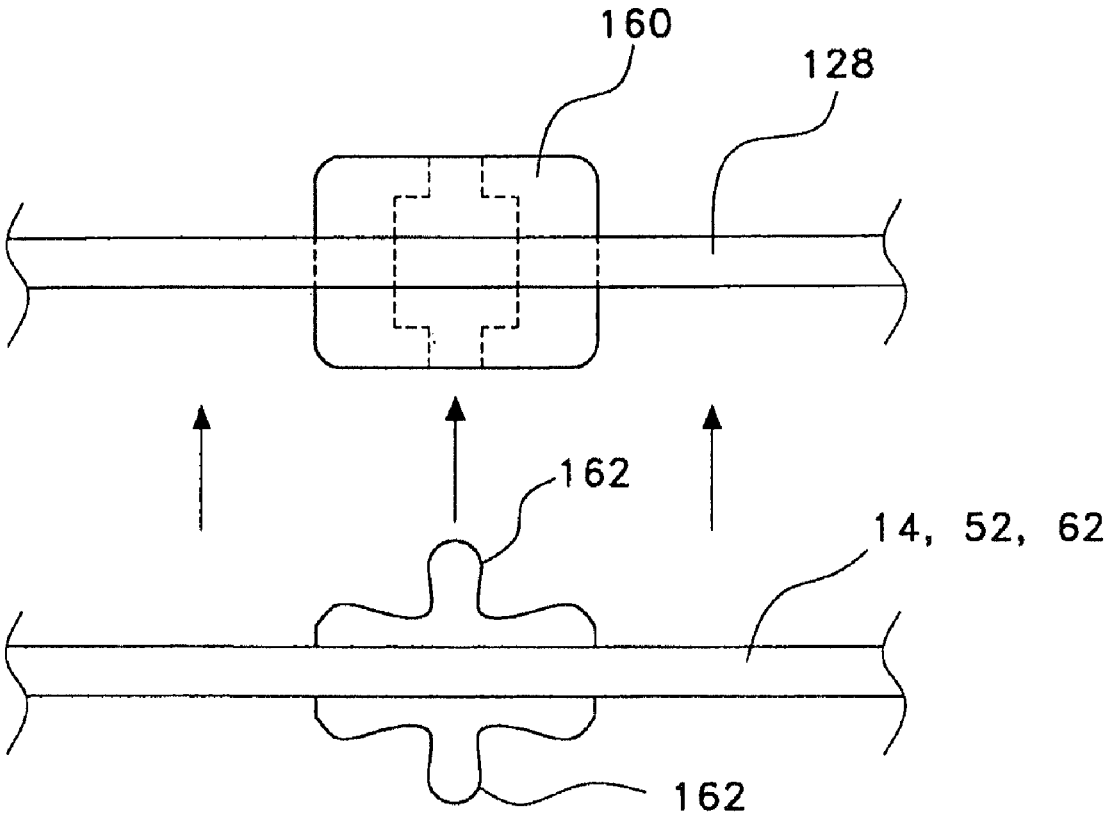

FIG. 20C illustrates another example of the fastener types 140. Sheet material 128 has a first part of a snap fastener 150 attached to the upper and lower surfaces thereof. Sheet 14, 52, 62 has the other part of the snap fastener 152 attached to the upper and lower surfaces thereof. In this arrangement, the sheet material 128 is disposable on the either upper or lower surface of the sheet 14, 52, 62, and is secured by mating the first and second parts of the snap fasteners 150, 152 together. It is understood that either part of the snap fastener 140 of FIG. 20C is disposable on the sheet material 128, so long as the mating part is disposed in a mirrored fashion on the sheet 14, 52, 62.

FIG. 20D illustrates another example of the fastener types 140. Sheet material 128 has a grommet 160 attached thereon, forming a reinforced aperture in the sheet material 128. Sheet 14, 52, 62 has resilient tongue member 162 attached to the upper and lower surfaces thereof. In this arrangement, the sheet material 128 is disposable on the either upper or lower surface of the sheet 14, 52, 62, and is secured by mating the resilient tongue member 162 with the grommet 160 together. It is understood that either the grommet 160 or the resilient tongue member 162 of the fastener 140 of FIG. 20D is disposable on the sheet material 128, so long as the mating part is disposed in a mirrored fashion on the sheet 14, 52, 62. In addition, it is well within the purview of the instant invention that resilient tongue member 162 is may be any mechanism the is capable of being coupled to a grommet so as the detachable blanket 126 is secured to the sheet 14, 52, 62 without interfering with the comfort of the infant wrapped in the detachable blanket 126.

It is well within the abilities of one skilled in the art to alter the shape and/or size of the fitted sheet and blanket to fit a variety of different infant sleeping devices such as cribs, bassinets, incubators and playpens. The sheet and the blanket may be made from any suitable material, including cotton, wool, polyester, silk, Lycra®, and nylon. Likewise, any other variant of mating fastener for securing the detachable blanket to the sheet or sleep surface cover is consider within the scope of the appended claims of the invention.

It is to be understood that the present invention is not limited to the arrangements described above, but encompasses any and all arrangements within the scope of the following claims.

I claim:

1. A combination safety sheet and separable blanket for infants, comprising:

at least one mating fastener pair, said pair includes a first portion and a second portion;

a sheet designed and configured to be secured to a sleep surface, said sheet having a first surface and a second surface;

said first portion of said fastener pair being attached to at least one of said first surface and said second surface of said sheet;

a blanket having a top surface, a bottom surface, and at least two edges;

said second portion of said fastener pair being attached to said bottom surface and said second surface of said sheet;

wherein said blanket being removably attached to said sheet by said first and second portions of each of said at least one mating fastener pair;

whereby said at least two edges are overlapped so that said blanket may be wrapped about an infant in order to retain the infant in a supine position while sleeping, such that when said blanket is removably attached to said sheet and said at least two edges are overlapped, every fastener attached to said sheet is completely covered by said blanket; and wherein the blanket is configured to wrap around the infant and the blanket and the sheet are configured such that arms and shoulders of the infant are free.

2. The combination safety sheet and separable blanket according to claim 1, wherein said first and second portions of each at least one said mating pair of fasteners are selected from the group consisting of hook and loop fastening members, a first and a second snap fastener member, and grommet and resilient grommet pin.

* * * * *